US011702614B2

(12) United States Patent
Ishii et al.

(10) Patent No.: US 11,702,614 B2
(45) Date of Patent: Jul. 18, 2023

(54) LUBRICATING OIL COMPOSITION

(71) Applicant: ENEOS Corporation, Tokyo (JP)

(72) Inventors: Mona Ishii, Tokyo (JP); Hitoshi Komatsubara, Tokyo (JP)

(73) Assignee: ENEOS Corporation, Tokyo (JP)

( * ) Notice: Subject to any disclaimer, the term of this patent is extended or adjusted under 35 U.S.C. 154(b) by 0 days.

(21) Appl. No.: 17/438,747

(22) PCT Filed: Mar. 13, 2020

(86) PCT No.: PCT/JP2020/011245
§ 371 (c)(1),
(2) Date: Sep. 13, 2021

(87) PCT Pub. No.: WO2020/189580
PCT Pub. Date: Sep. 24, 2020

(65) Prior Publication Data

US 2022/0145208 A1 May 12, 2022

(30) Foreign Application Priority Data

Mar. 20, 2019 (JP) ..... 2019-053620

(51) Int. Cl.
*C10M 141/12* (2006.01)
*C10M 169/04* (2006.01)
(Continued)

(52) U.S. Cl.
CPC ..... *C10M 169/044* (2013.01); *C10M 129/50* (2013.01); *C10M 129/54* (2013.01); *C10M 133/46* (2013.01); *C10M 135/10* (2013.01); *C10M 135/24* (2013.01); *C10M 135/26* (2013.01); *C10M 137/10* (2013.01); *C10M 139/00* (2013.01); *C10M 141/12* (2013.01); *C10M 151/02* (2013.01); *C10M 161/00* (2013.01); *C10M 2203/003* (2013.01); *C10M 2207/141* (2013.01); *C10M 2207/144* (2013.01); *C10M 2215/30* (2013.01); *C10M 2219/044* (2013.01); *C10M 2219/084* (2013.01); *C10M 2219/085* (2013.01); *C10M 2221/02* (2013.01); *C10M 2223/045* (2013.01); *C10M 2223/049* (2013.01); *C10M 2227/06* (2013.01);
(Continued)

(58) Field of Classification Search
CPC ..... C10M 169/044; C10M 129/50; C10M 129/54; C10M 133/46; C10M 135/10; C10M 135/24; C10M 135/26; C10M 137/10; C10M 139/00; C10M 141/12; C10M 151/02; C10M 161/00; C10M 2203/003; C10M 2207/141; C10M 2207/144; C10M 2215/30; C10M 2219/044; C10M 2219/084; C10M 2219/085; C10M 2221/02; C10M 2223/045; C10M 2223/049; C10M 2227/06; C10N 2030/04; C10N 2030/52; C10N 2040/25; C10N 2040/40
USPC ..... 508/186
See application file for complete search history.

(56) References Cited

U.S. PATENT DOCUMENTS 5,580,482 A 12/1996 Chasan et al.
2009/0082235 A1* 3/2009 Hilker ..... C10M 141/08 508/567
(Continued)

FOREIGN PATENT DOCUMENTS

CN 101198682 A 6/2008
CN 104560297 A 4/2015
(Continued)

OTHER PUBLICATIONS

Japanese Patent Office, International Preliminary Report on Patentability in International Patent Application No. PCT/JP2020/011245 (dated Sep. 16, 2021).
(Continued)

*Primary Examiner* — Prem C Singh
*Assistant Examiner* — Francis C Campanell
(74) *Attorney, Agent, or Firm* — Leydig, Voit & Mayer, Ltd.

(57) ABSTRACT

Disclosed is a lubricating oil composition capable of having a good balance of electrical insulation, seizure resistance and wear resistance. In particular, the lubricating oil composition comprises: (A) a lubricant base oil; (B) an alkaline earth metal detergent; (C) a triazole-based compound represented by the following general formula (1) or (2):

(1)

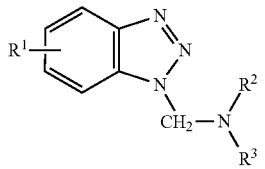

(2)

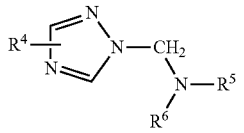

wherein $R^1$-$R^6$ are as defined herein; (D) at least one sulfur-containing compound selected from the group consisting of a sulfur-containing heterocyclic ether compound and a sulfide compound; and (E) an ashless dispersant.

19 Claims, No Drawings

(51) Int. Cl.

| | |
|---|---|
| ***C10M 129/50*** | (2006.01) |
| ***C10M 129/54*** | (2006.01) |
| ***C10M 133/46*** | (2006.01) |
| ***C10M 135/10*** | (2006.01) |
| ***C10M 135/24*** | (2006.01) |
| ***C10M 135/26*** | (2006.01) |
| ***C10M 137/10*** | (2006.01) |
| ***C10M 139/00*** | (2006.01) |
| ***C10M 151/02*** | (2006.01) |
| ***C10M 161/00*** | (2006.01) |
| *C10N 30/00* | (2006.01) |
| *C10N 40/00* | (2006.01) |
| *C10N 30/04* | (2006.01) |
| *C10N 40/25* | (2006.01) |

(52) U.S. Cl.

CPC ..... *C10N 2030/04* (2013.01); *C10N 2030/52* (2020.05); *C10N 2040/25* (2013.01); *C10N 2040/40* (2020.05)

(56) References Cited

U.S. PATENT DOCUMENTS

| | | | | |
|---|---|---|---|---|
| 2009/0275491 | A1* | 11/2009 | Komatsubara ..... | C10M 163/00 508/192 |
| 2010/0144565 | A1 | 6/2010 | Ikeda et al. | |
| 2010/0218740 | A1 | 9/2010 | Teshima et al. | |
| 2011/0041797 | A1 | 2/2011 | Strickland et al. | |
| 2020/0071634 | A1* | 3/2020 | Mori ..... | C10M 141/10 |

FOREIGN PATENT DOCUMENTS

| | | | |
|---|---|---|---|
| CN | 105087113 | A | 11/2015 |
| CN | 107429186 | A | 12/2017 |
| EP | 1405897 | A1 | 4/2004 |
| JP | H08-231976 | A | 9/1996 |
| JP | 2002-003877 | A | 1/2002 |
| JP | 2008-285682 | A | 11/2008 |
| JP | 2009-029968 | A | 2/2009 |
| JP | 2009-102486 | A | 5/2009 |
| JP | 2011-042792 | A | 3/2011 |
| JP | 2016-108406 | A | 6/2016 |
| JP | 2017-160366 | A | 9/2017 |

OTHER PUBLICATIONS

Japanese Patent Office, International Search Report in International Patent Application No. PCT/JP2020/011245 (dated Jun. 2, 2020).

China National Intellectual Property Administration, First Office Action in Chinese Patent Application No. 202080014305.1 (dated Apr. 8, 2022).

European Patent Office, Extended European Search Report in European Patent Application No. 20773142.3 (dated Nov. 3, 2022).

China National Intellectual Property Administration, Office Action in Chinese Patent Application No. 202080014305.1 (dated Jan. 9, 2023).

* cited by examiner

LUBRICATING OIL COMPOSITION

BACKGROUND OF THE INVENTION

Field of the Invention

The present invention relates to a lubricating oil composition, in particular a lubricating oil composition for a powertrain of a hybrid or an electric vehicle, especially a lubricating oil composition for motor cooling oil or reducer oil of an electric power train.

Background Art

A hybrid or an electric vehicle provides some or all of its power from electric motors and generators installed on the vehicle. These vehicles with high fuel efficiency are rapidly gaining popularity and are expected to gain further in the future, since they reduce the use of fossil fuels and contribute to $CO_2$ reduction.

Recently, in the hybrid or electric vehicle, a method of cooling an electric motor with cooling oil has been widely adopted because efficient heat release from the motor of an electric power train leads to improved power generation efficiency. Mainly used as the cooling oil are lubricating oil compositions such as the existing automatic transmission fluid (ATF) and continuously variable transmission fluid (CVTF). Further, with respect to the reducer oil, the automatic transmission fluid and manual transmission oil (MTF) are also used as the lubricating oil compositions. However, while various additives contained in these lubricating oil compositions improve the properties in controlling friction of the wet clutches and the wear prevention properties between the metals (wear resistance between metals), and the anti-seizure properties between the metals (seizure resistance between metals), they also have the disadvantage of greatly impairing the electrical insulation (relative dielectric constant). Therefore, there is a concern that electrical insulation is insufficient when these lubricating oil compositions are used in an electric power train, causing insulation breakdown and resulting in poor running. Therefore, the lubricating oil composition for a power train of hybrid and electric vehicles is required not only to have excellent anti-wear and anti-seizure performance between metals but also to have excellent electrical insulation in order to secure reliability in terms of electrical insulation of an electric motor.

For example, Patent Document 1 proposes a gearbox oil composition containing (A) 0.03 to 0.1 mass % of an oil-soluble molybdenum compound in an amount of molybdenum, (B) 0.01 to 2 mass % of an antioxidant, (C) 0.01 to 2 mass % of a metallic detergent in an amount of metal, (D) 0.005 to 0.05 mass % of a boron-containing ashless dispersant in an amount of boron, and (E) 0.01 to 0.1 mass % of a phosphorus extreme pressure agent in an amount of phosphorus, and (F) 0.01 to 0.2 mass % of a triazole derivative, in a base oil in order to improve wear resistance between metals.

PRIOR ART DOCUMENT

Patent Document

[Patent Document 1] Japanese Unexamined Patent Publication No. 2009-029968

SUMMARY OF THE INVENTION

Problems to be Solved by the Invention

However, since the gearbox oil composition described in Patent Document 1 has not been examined in terms of electrical insulation, there was room for improvement in using it as a lubricating oil composition for a power train of hybrid and electric vehicles.

The problem of the present invention is to provide a lubricating oil composition that is capable of having a good balance of electrical insulation, anti-seizure, and anti-wear properties.

Means for Solving the Problem

As a result of intensive research to solve the above problem, the present inventors have found that the above problem can be solved by blending (B) an alkaline earth metal detergent to adjust the amount of alkaline earth metal, blending (C) a triazole-based compound having a specific structure in a specific content, blending (D) at least one sulfur-containing compound selected from a sulfur-containing heterocyclic ether compound and a sulfide compound to adjust the amount of sulfur, and blending (E) an ashless dispersant at a specific content in a lubricating oil composition, thereby completing the present invention.

That is, according to the present invention, the following invention is provided.

[1] A lubricating oil composition comprising:

(A) a lubricant base oil;

(B) an alkaline earth metal detergent, wherein the amount of the alkaline earth metal is 10 ppm or more by mass and 1000 ppm or less by mass on the basis of the total amount of the lubricating oil composition;

(C) 0.005% or more by mass and 0.90% or less by mass of a triazole-based compound represented by the following general formula (1) or (2), on the basis of the total amount of the lubricating oil composition:

(1)

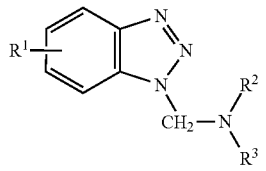

wherein $R^1$ is a hydrogen atom or a methyl group, and $R^2$ and $R^3$ are each independently a hydrogen atom or a linear or branched hydrocarbon having 1 to 18 carbons, (2)

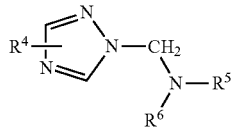

wherein $R^4$ is a hydrogen atom or a methyl group, and $R^5$ and $R^6$ are each independently a hydrogen atom or a linear or branched hydrocarbon having 1 to 18 carbons;

(D) at least one sulfur-containing compound selected from the group consisting of a sulfur-containing heterocyclic ether compound and a sulfide compound, wherein the amount of sulfur is 10 ppm or more by mass and 2000 ppm or less by mass, on the basis of the total amount of the lubricating oil composition; and (E) 0.010% or more by mass and 4.0% or less by mass of an ashless dispersant on the basis of the total amount of the lubricating oil composition.

[2] The lubricating oil composition according to [1], wherein the content of the (B) alkaline earth metal detergent is 80 mass ppm or more and 300 mass ppm or less as the amount of alkaline earth metal, on the basis of the total amount of the lubricating oil composition.

[3] The lubricating oil composition according to [1] or [2], wherein the (B) alkaline earth metal detergent is an alkaline earth metal sulfonate.

[4] The lubricating oil composition according to any one of [1] to [3], wherein the total base number of the (B) alkaline earth metal detergent is 100 mgKOH/g or more and 500 mgKOH/g or less.

[5] The lubricating oil composition according to any one of [1] to [4], wherein the content of the (C) triazole-based compound is 0.03% or more by mass and 0.20% or less by mass on the basis of the total amount of the lubricating oil composition.

[6] The lubricating oil composition according to any one of [1] to [5], wherein the content of the (D) sulfur-containing compound is 300 ppm or more by mass and 2000 ppm or less by mass as the sulfur amount, on the basis of the total amount of the lubricating oil composition.

[7] The lubricating oil composition according to any one of [1] to [6], wherein the (D) sulfur-containing heterocyclic ether compound is a sulfolan-based compound.

[8] The lubricating oil composition according any one of [1] to [6], wherein the (D) sulfide compound is represented by the following general formula (15):

$$R^{27}—S—R^{28} \quad (15)$$

wherein $R^{27}$ and $R^{28}$ are each independently a substituted or unsubstituted hydrocarbon group having 2 to 20 carbons, and at least one of $R^{27}$ and $R^{28}$ has a hydroxy group and/or a carboxyl group as a substituent.

[9] The lubricating oil composition according to any one of [1] to [8], wherein the content of the (E) ashless dispersant is 0.30% or more by mass and 2.5% or less by mass on the basis of the total amount of the lubricating oil composition.

[10] The lubricating oil composition according to any one of [1] to [9], wherein the (E) ashless dispersant is alkenyl succinimide or a derivative thereof.

[11] The lubricating oil composition according to any one of [1] to [10], wherein the (E) ashless dispersant comprises a boric acid modified compound of alkenyl succinimide.

[12] The lubricating oil composition according to any one of [1] to [11], wherein when the (A) lubricant base oil contains an ester base oil, the content of the ester base oil is 10% by mass or less on the basis of the total amount of the (A) lubricant base oil.

[13] The lubricating oil composition according to any one of [1] to [12], further comprising 100 to 1500 ppm by mass of a phosphorous compound as an amount of phosphorus elemental on the basis of the total amount of the lubricating oil composition.

[14] The lubricating oil composition according to [13], wherein the (F) phosphorus-based compound is phosphite ester.

[15] The lubricating oil composition according to [13], wherein the (F) phosphorus-based compound is a zinc dialkyldithiophosphate.

[16] The lubricating oil composition according to any one of [1] to [15], used in a power train of a hybrid or an electric vehicle.

[17] The lubricating oil composition according to [16], used as a motor cooling oil or a reducer oil for the power train.

[18] A method of lubricating a power train of a hybrid or an electric vehicle, using the lubricating oil composition according to any one of [1] to [15].

Effect of the Invention

The lubricating oil composition according to the present invention can improve electrical insulation, wear resistance and seizure resistance in a well-balanced manner. Such a lubricating oil composition can be suitably used for power train application of a hybrid or an electric vehicle requiring these performances, and particularly for motor cooling oil or reducer oil application of an electric power train.

MODE FOR CARRYING OUT THE INVENTION

[Lubricating Oil Composition]

A lubricating oil composition according to the present invention comprises at least (A) a lubricant base oil, (B) an alkaline earth metal detergent, (C) a triazole-based compound, (D) a sulfur-containing compound, and (E) an ashless dispersant, and may further comprise (F) a phosphorus-based compound, (G) an antioxidant, and the like. The lubricating oil composition according to the present invention can be suitably used in a power train of a hybrid or an electric vehicle, particularly in a motor cooling oil or a reducer oil for a power train. The components constituting the lubricating oil composition according to the present invention is described in details below.

[(A) Lubricant Base Oil]

A lubricant base oil is not particularly limited, and examples thereof include paraffin base oil, normal paraffin base oil, isoparaffin base oil, and mixtures thereof, which are obtained by atmospheric distillation and/or vacuum distillation of crude oil, thereby giving a lubricant fraction which is then purified by one or a combination of two or more selected from purification treatments such as solvent deasphalting, solvent extraction, hydrocracking, solvent dewaxing, catalytic dewaxing, hydrorefining, sulfuric acid washing, clay treatment, and the like.

Preferable examples of the lubricant base oil include base oils obtained by using the following base oils (1) to (8) as raw materials, purifying those raw material oils and/or the lubricating oil fraction recovered from those raw material oils with a predetermined purification method, and recovering the lubricating oil fraction.

(1) Distillate oil obtained by atmospheric distillation of paraffin-based crude oil and/or mixed-based crude oil;

(2) Distillate oil obtained by reduced-pressure distillation of paraffin-based crude oil and/or mixed-based crude oil (WVGO);

(3) Wax (slack wax, etc.) obtained by a lubricating oil dewaxing step and/or synthetic wax (Fischer-Tropsch wax, GTL wax, etc.) obtained by a gas to liquid (GTL) process;

(4) Mixed oil of one or two or more selected from base oils (1) to (3) and/or mild hydrocracking treated oil of the mixed oil;

(5) Mixed oil of two or more selected from base oils (1) to (4);

(6) Deasphalting oil (DAO) of base oils (1), (2), (3), (4) or (5);

(7) Mild hydrocracking treated oil (MHC) of base oil (6);

(8) Mixed oil of two or more selected from base oils (1) to (7).

Preferred as the above-mentioned predetermined purification method are hydropurification such as hydrocracking or hydrofinishing; solvent purification such as furfural solvent extraction; dewaxing such as solvent dewaxing or catalytic dewaxing; clay purification using acid clay or activated clay; and chemical (acid or alkali) cleaning such as sulfuric acid cleaning or caustic soda cleaning. In the present invention, one of these purification methods may be performed alone, or two or more of these purification methods may be performed in combination. When two or more purification methods are combined, the order can be selected as needed with no particular limitation.

Further, the following base oils (9) and (10) are particularly suitable as the lubricant base oil, which are obtained by performing a predetermined treatment for the base oil selected from the base oils (1) to (8) above or the lubricating oil fraction recovered from the base oils.

(9) A hydrocracking base oil obtained by hydrocracking the base oil selected from the base oils (1) to (8) above or the lubricating oil fraction recovered from the base oils, thereby obtaining a resultant and carrying out dewaxing treatment such as solvent dewaxing or catalytic dewaxing on the resultant or the lubricating oil fraction recovered from distillation, etc. from the resultant, or carrying out distillation after carrying out the dewaxing treatment.

(10) A hydroisomerized base oil obtained by hydroisomerizing a base oil selected from the base oils (1) to (8) or a lubricating oil fraction recovered from the base oils, and subjecting the resultant or the lubricating oil fraction recovered from the resultant by distillation, etc. to a dewaxing treatment such as solvent dewaxing or catalytic dewaxing, or carrying out distillation after the dewaxing treatment. Preferred is a base oil produced by undergoing the catalytic dewaxing step as the dewaxing step.

In obtaining the lubricant base oil of (9) or (10) above, a solvent purification treatment and/or a hydrofinishing treatment step may be further performed at an appropriate stage as necessary.

Although the catalyst used for the hydrocracking/hydroisomerization is not particularly limited, preferred for use is a hydrocracking catalyst in which a complex oxide having a decomposition activity (for example, silica alumina, alumina boria, silica zirconia, etc.) or a combination of one or more types of the complex oxide and bound with a binder is used as a carrier, and a metal having a hydrogenation ability (for example, one or more of metals of Group VIa and Group VIII of the Periodic Table) is supported, or a hydroisomerization catalyst in which a metal having a hydrogenation ability including at least one of metal of Group VIII is supported on a carrier containing a zeolite (for example, ZSM-5, zeolite beta, SAPO-11, etc.). The hydrocracking catalyst and the hydroisomerization catalyst may be used in combination such as by lamination or mixing.

The reaction conditions during the hydrocracking/hydroisomerization are not particularly limited, and it is preferable that the hydrogen partial pressure is 0.1 to 20 MPa, the average reaction temperature is 150 to 450° C., LHSV is 0.1 to 3.0 $hr^{-1}$, and the hydrogen/oil ratio is 50 to 20000 scf/b.

The kinematic viscosity of the lubricant base oil at 100° C. is preferably 1.7 $mm^2/s$ or more and 8.0 $mm^2/s$ or less, more preferably 2.2 $mm^2/s$ or more and 7.0 $mm^2/s$ or less, further preferably 3.0 $mm^2/s$ or more and 6.0 $mm^2/s$ or less. When the kinematic viscosity of the lubricant base oil at 100° C. is within the above-described numerical ranges, sufficient fuel efficiency can be obtained, and the oil film can be formed satisfactorily at the lubricating area, resulting in excellent lubricity. As used herein, "kinematic viscosity at 100° C." means kinematic viscosity at 100° C. measured according to JIS K 2283-2010.

The kinematic viscosity of the lubricant base oil at 40° C. is preferably 5.0 $mm^2/s$ or more and 40 $mm^2/s$ or less, more preferably 7.0 $mm^2/s$ or more and 35 $mm^2/s$ or less, further preferably 10 $mm^2/s$ or more and 30 $mm^2/s$ or less. When the kinematic viscosity of the lubricant base oil at 40° C. is within the above-mentioned numerical ranges, sufficient fuel efficiency can be obtained, and the oil film can be formed satisfactorily at the lubricating area, resulting in excellent lubricity. As used herein, "kinematic viscosity at 40° C." means kinematic viscosity at 40° C. measured according to JIS K 2283-2010.

The viscosity index of the lubricant base oil is preferably 100 or more, more preferably 110 or more, and may be further more preferably 120 or more. When the viscosity index is within the above-mentioned numerical ranges, viscosity-temperature properties, heat/oxidation stability, and volatility prevention properties of the lubricating oil composition are improved, so that the friction coefficient is reduced and thus wear resistance can be further improved. As used herein, "viscosity index" means a viscosity index measured in accordance with JIS K 2283-2010.

The density ($\rho_{15}$) of the lubricant base oil at 15° C. is preferably 0.860 or less, more preferably 0.850 or less, and further preferably 0.840 or less. As used herein, the "density" at 15° C. means the density at 15° C. measured according to JIS K 2249-1995.

The pour point of the lubricant base oil is preferably −10° C. or less, more preferably −12.5° C. or less, and further preferably −15° C. or less. When the pour point is within the above numerical ranges, low-temperature fluidity of the entire lubricating oil composition can be improved. As used herein, "pour point" means a pour point measured in accordance with JIS K 2269-1987.

The sulfur component of the lubricant base oil depends on the sulfur component of the raw material. For example, when a substantially sulfur-free raw material such as a synthetic wax component obtained by a Fischer-Tropsch reaction, etc. is used, a substantially sulfur-free lubricant base oil can be obtained. When a raw material including sulfur such as a slack wax obtained by a refining process of the lubricant base oil or a microwax component obtained by a refining process of the lubricant base oil is used, the sulfur component in the lubricant base oil is usually 100 ppm by mass or more. In the lubricant base oil, the sulfur component is preferably 100 ppm or less by mass, more preferably 50 ppm or less by mass, and further preferably 10 ppm or less by mass from the viewpoint of improvement of heat/oxidation stability and sulfur reduction. As used herein, "the sulfur component of the lubricant base oil" means a value measured in accordance with JIS K 2541-2003.

The content of the saturated component in the lubricant base oil is preferably 90% or more by mass, preferably 95% or more by mass, and more preferably 99% or more by mass, on the basis of the total amount of the lubricant base oil. By making the content of the saturated component satisfy the above conditions, the viscosity-temperature properties and heat/oxidation stability can be improved, and also when an additive is added to the lubricant base oil, the function of the additive can be expressed at a higher level while sufficiently stably dissolving and retaining the additive in the lubricant base oil. Further, it is possible to improve the friction properties of the lubricant base oil itself, and as a result, it is possible to achieve improvement in the effect of friction reduction, which leads to improvement in fuel efficiency. As used herein, the content of the saturated component means a value measured according to ASTM D 2007-93.

The proportion of the cyclic saturated component in the above-described saturated component in the lubricant base oil is preferably 3% or more by mass, more preferably 5% or more by mass. The proportion is preferably 40% or less by mass, preferably 35% or less by mass, preferably 30% or less by mass, more preferably 25% or less by mass, and further preferably 21% or less by mass. When the proportion of the cyclic saturated component in the saturated component in the lubricant base oil satisfies the above condition, the viscosity-temperature properties and heat/oxidation stability can be improved, and when an additive is added to the lubricant base oil, the function of the additive can be expressed at a higher level while sufficiently stably dissolving and retaining the additive in the lubricant base oil. In this specification, the content of the cyclic saturated component in the saturated component in the lubricant base oil means a value measured under the following conditions.

[Test Conditions]

Test Device: JMS-MS700V, manufactured by JEOL Ltd.

Sample Introduction Method: Glass Reservoir

Resolution: 500

Test Method: according to ASTM D2786-91

However, instead of Chapter 8 in ASTM D2786-91, the measurement conditions shall be determined by calibration so as to satisfy the following conditions:

$$\Sigma 67/\Sigma 71=0.20 \text{ to } 0.22$$

$$\Sigma 69/\Sigma 71=0.14 \text{ to } 0.16$$

$$H127/H226=0.80 \text{ to } 0.85$$

wherein Σ67, Σ69 and Σ71 are as defined in ASTM D2786, respectively, and H127 and H226 are the peak intensities at m/z=127 and 226, respectively.

The amount of introduction into the ion source is set so that the peak at m/z=57, which has the highest intensity among the detection peaks of n-hexadecane, is not saturated.

If there is a circumstance where it is not possible to perform measurement using the apparatus and/or the sample introduction method, similar apparatus complied with ASTM E137 can be used and similar results are obtained. In this case, the test conditions shall be in accordance with the contents described in the preceding paragraph.

The aromatic component in the lubricant base oil is preferably 10% or less by mass, more preferably 5% or less by mass, further preferably 4% or less by mass, further more preferably 3% or less by mass, and most preferably 2% or less by mass, on a total amount basis of the lubricant base oil. When the content of the aromatic component is within the above-described numerical ranges, viscosity-temperature properties, thermal/oxidation stability and friction characteristics, as well as low volatilities and low-temperature viscosity characteristics are improved.

In the present specification, the aromatic component means a value measured according to ASTM D 2007-93. Examples of the aromatic component include alkylbenzene, alkylnaphthalene, anthracene, phenanthrene, and their alkylated products, compounds having four or more fused benzene rings, and aromatic compounds having heteroatoms such as pyridines, quinolines, phenols and naphthols.

As the lubricant base oil, group II base oil, group III base oil, group IV base oil, or group V base oil of the API base oil classification, or a mixture of these base oils can be preferably used. The API group II base oil is a mineral oil base oil having a sulfur component of 0.03% or less by mass, a saturation content of 90% or more by mass, and a viscosity index of 80 or more and less than 120. The API group III base oil is a mineral oil base oil having a sulfur component of 0.03% or less by mass, a saturation content of 90% or more by mass, and a viscosity index of 120 or more. The API group IV base oil is a poly α-olefin base oil. The API group V base oil is a base oil that does not belong to any of the Groups I to IV and one example is an ester base oil.

A synthetic base oil may be used as the lubricant base oil. Examples of the synthetic base oil include poly α-olefin and hydrides thereof, isobutene oligomer and hydrides thereof, isoparaffin, alkylbenzene, alkylnaphthalene, monoester (butyl stearate, octyl laurate, 2-ethyl hexyl oleate, etc.), diester (ditridecyl glutalate, di-2-ethylhexyl adipate, diisodecyl adipate, ditridecyl adipate, di-2-ethylhexyl sebacate, etc.), polyol ester (trimethylol propane caprylate, trimethylol propane pelargonate, pentaerythritol 2-ethylhexanoate, pentaerythritol pelargonate, etc.), polyoxyalkylene glycol, dialkyldiphenyl ether, polyphenyl ether, and mixtures thereof, among which poly α-olefin is preferable. Typical examples of poly α-olefin include oligomers or co-oligomers of α-olefins having 2 to 32 carbons, preferably 6 to 16 carbons (1-octene oligomer, decene oligomer, ethylene-propylene co-oligomer, etc.), and hydrogenation products thereof.

The process for producing the poly α-olefin is not particularly limited, and may include for example, a process for polymerizing α-olefin in the presence of a polymerization catalyst such as a catalyst comprising a complex of aluminum trichloride or boron trifluoride with water, alcohol (ethanol, propanol, butanol, etc.), carboxylic acid or ester.

When the lubricant base oil contains an ester base oil, the content of the ester base oil is preferably 10% or less by mass, more preferably 5% or less by mass, further preferably 1% or less by mass, further more preferably 0% by mass, on the basis of the total amount of the lubricant base oil. When the content of the ester base oil in the lubricant base oil is within the above-described numerical range, the relative dielectric constant can be further reduced.

The lubricant base oil may comprise a single base oil component or may comprise a plurality of base oil components as an entire lubricant base oil.

The content of the lubricant base oil in the lubricating oil composition is usually 70% or more by mass, preferably 75% or more by mass, more preferably 80% or more by mass, and usually 98% or less by mass, on the basis of the total amount of the lubricating oil composition.

[(B) Alkaline Earth Metal Detergent]

Examples of the alkaline earth metal detergent include a phenate-based detergent, a sulfonate-based detergent, and a salicylate-based detergent. These detergents can be used alone or use of two or more is possible in combination. Note that, in the present specification, the "alkaline earth metal" encompasses magnesium.

Preferred examples of the phenate-based detergent include an overbased salt of an alkaline earth metal salt of a compound having a structure represented by the following general formula (3). Examples of the alkaline earth metal include calcium, magnesium, barium, and among these, calcium or magnesium is preferable.

(3)

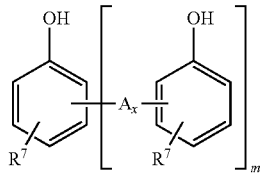

In general formula (3), $R^7$ represents a linear or branched chain, a saturated or unsaturated alkyl group or alkenyl group, m represents the polymerization degree, A represents a sulfide (—S—) group or a methylene (—$CH_2$—) group, and x represents an integer of 1 to 3. $R^7$ may be a combination of two or more different groups. In general formula (3), the number of carbons of $R^7$ is 6 to 21, preferably 9 to 18, more preferably 9 to 15. When the number of carbons of $R^7$ is in the above-mentioned ranges, solubility and heat resistance can be improved. The polymerization degree m in general formula (3) is an integer of 1 to 10, preferably 1 to 4. When the polymerization degree m is within the above-described numerical ranges, heat resistance can be improved.

Preferred examples of the sulfonate-based detergent include an alkaline earth metal salt of an alkyl aromatic sulfonic acid obtained by sulfonating an alkyl aromatic compound or a basic salt or an overbased salt thereof, that is, a basic salt or an overbased salt of a compound having a structure represented by the following general formula (4) can be preferably exemplified. Examples of the alkaline earth metal include calcium, magnesium, and barium, and among these, calcium or magnesium is preferable.

(4)

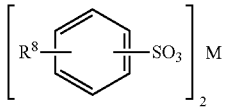

In the above general formula (4), $R^8$ each independently represents an alkyl group or an alkenyl group having 23 to 102 carbons, and M represents an alkaline earth metal. The weight average molecular weight of the alkyl aromatic compound is preferably 400 or more and 1500 or less, more preferably 700 or more and 1300 or less.

Examples of the alkyl aromatic sulfonic acid include the so-called petroleum sulfonic acids and synthetic sulfonic acids. Examples of the petroleum sulfonic acids include those obtained by sulfonating an alkyl aromatic compound of a lubricating oil fraction of a mineral oil and the so-called mahogany acids produced as a by-product in the production of white oil, and the like. One example also includes those obtained by sulfonating alkylbenzene having a linear or branched alkyl group obtained by recovering by-products in a production plant of alkylbenzene which is the raw material of a detergent, or by alkylating benzene with polyolefin. Another example of the synthetic sulfonic acid includes one which is obtained by sulfonating alkyl naphthalene such as dinonyl naphthtalene. Also, there is no particular limitation to the sulfonating agent to sulfonate these alkyl aromatic compounds, examples thereof including oleum and anhydrous sulfuric acid.

Preferred examples of the salicylate-based detergent include alkali earth metal salicylate or a basic salt or an overbased salt thereof. Preferred examples of the alkali earth metal salicylate include a compound represented by the following general formula (5). Examples of the alkali earth metal include calcium, magnesium, barium etc. and calcium or magnesium is preferred.

(5)

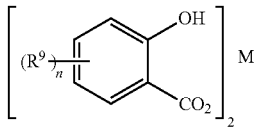

In the above general formula (5), $R^9$ each independently represents an alkyl group or alkenyl group having 14 to 30 carbons, and M represents an alkaline earth metal.

A method for producing an alkaline earth metal salicylate is not particularly limited, and for example, a known method for producing a monoalkyl salicylate can be used. For example, the alkaline earth metal salicylate can be obtained by reacting a monoalkyl salicylic acid that is obtained by alkylation of the starting material, phenol with an olefin, and then by carboxylation with carbon dioxide, etc., or a monoalkyl salicylic acid that is obtained by alkylation of the starting material, salicylic acid with an equivalent amount of the above olefin, with a base of an alkaline earth metal such as an oxide or hydroxide of an alkaline earth metal, or by converting these monoalkyl salicylic acids into an alkaline metal salt such as a sodium salt or potassium salt and then metal interchanging the alkali metal salt with an alkaline earth metal salt, and thereby obtaining alkaline earth metal salicylate.

The alkaline earth metal detergent may be overbased with an alkaline earth metal carbonate or with an alkaline earth metal borate.

A method for obtaining an alkaline earth metal detergent overbased with an alkaline earth metal carbonate is not particularly limited, and can be obtained, for example, by reacting a neutral salt of an alkaline earth metal detergent (such as an alkaline earth metal phenate, an alkaline earth metal sulfonate, or an alkaline earth metal salicylate) with an alkaline earth metal base (such as an alkaline earth metal hydroxide or oxide) in the presence of carbon dioxide gas.

A method for obtaining an alkaline earth metal detergent overbased with an alkaline earth metal borate is not particularly limited, and can be obtained by reacting a neutral salt of an alkaline earth metal detergent (such as an alkaline earth metal phenate, an alkaline earth metal sulfonate, an alkaline earth metal salicylate) with a base of an alkaline earth metal (alkaline earth metal hydroxide or oxide) in the presence of boric acid or boric anhydride or a borate.

As the alkaline earth metal detergent, an alkaline earth metal phenate, an alkaline earth metal sulfonate, an alkaline earth metal salicylate, or a combination thereof can be used, and an alkaline earth metal sulfonate is preferably used.

The total base number of the alkaline earth metal detergent is not particularly limited and may be 0, preferably 10 mg KOH/g or more and 500 mg KOH/g or less, more preferably 50 mg KOH/g or more and 500 mg KOH/g or less, and further preferably 100 mg KOH/g or more and 500 mg KOH/g or less. When the total base number of the alkaline earth metal detergent is within the above-mentioned ranges, acid neutralizing properties required for lubricating oil can be maintained, and wear resistance and seizure resistance can be further improved. When two or more alkaline earth metal detergents are mixed and used, it is preferable that the base number obtained upon mixing be within the above-mentioned ranges. Note that, the total base number is a value measured by ASTM D 2896.

The content of the alkaline earth metal detergent in the lubricating oil composition is 10 ppm or more by mass and 1000 ppm or less by mass, preferably 20 ppm or more by mass and 700 ppm or less by mass, more preferably 50 ppm or more by mass and 500 ppm or less by mass, and further preferably 80 ppm or more by mass and 300 ppm or less by mass as the alkaline earth metal detergent amount, on the basis of the total amount of the lubricating oil composition. When the content of the alkaline earth metal detergent is equal to or greater than the lower limits above, wear resistance and seizure resistance can be improved. In addition, when the content of the alkaline earth metal detergent is equal to or less than the upper limits above, electrical insulation can be improved. In this specification, the term "alkaline earth metal amount" means a value measured by inductively coupled plasma atomic emission spectrometry (intensity ratio method) in accordance with JPI-5S-38-2003.

[(C) Triazole-Based Compound]

The triazole-based compound is represented by the following general formula (1) or (2).

(1)

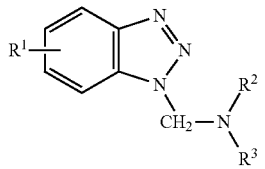

In general formula (1), $R^1$ is a hydrogen atom or a methyl group, preferably a methyl group.

$R^2$ and $R^3$ are each independently a hydrogen atom or a linear or branched hydrocarbon having 1 to 18 carbons, preferably a hydrogen atom or a linear or branched hydrocarbon having 1 to 12 carbons. The total number of carbons of $R^2$ and $R^3$ is from 0 to 36, preferably from 0 to 24, more preferably from 8 to 24.

(2)

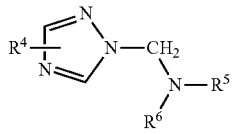

In general formula (2), $R^4$ represents a hydrogen atom or a methyl group, and preferably a hydrogen atom.

$R^5$ and $R^6$ each independently represent a hydrogen atom or a linear or branched hydrocarbon having 1 to 18 carbons, preferably a linear or branched hydrocarbon having 1 to 12 carbons. The total number of carbons of $R^5$ and $R^6$ is 0 to 36, preferably 0 to 24, more preferably 8 to 24.

The content of the triazole-based compound in the lubricating oil composition is 0.005% or more by mass and 0.90% or less by mass, preferably 0.01% or more by mass and 0.50% or less by mass, more preferably 0.02% or more by mass and 0.40% or less by mass, and further preferably 0.03% or more by mass and 0.20% or less by mass, on the basis of the total amount of the lubricating oil composition. When the content of the triazole-based compound is not less than the lower limits above, wear resistance can be improved. When the content of the triazole-based compound is not more than the upper limits above, electrical insulation and seizure resistance can be improved.

[(D) Sulfur-Containing Compound]

The sulfur-containing compound is added to adjust the amount of sulfur in the lubricating oil composition, and at least one compound selected from a sulfur-containing heterocyclic ether compound and a sulfide compound is used. One sulfur-containing compound may be used alone, or two or more is possibly used in combination.

Preferred examples of the sulfur-containing heterocyclic ether compound include an ether sulfolane compound having a structure represented by the following general formula (6):

(6)

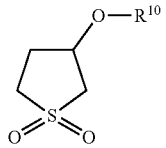

In the above general formula (6), $R^{10}$ is an alkyl group having 1 to 20 carbons, preferably an alkyl group having 8 to 16 carbons.

As for the sulfide compound, a sulfide compound having a structure represented by the following general formula (15) can be preferably exemplified.

$$R^{27}—S—R^{28} \quad (15)$$

In general formula (15), $R^{27}$ and $R^{28}$ are each independently a substituted or unsubstituted hydrocarbon group having 2 to 20 carbons, and at least one of $R^{27}$ and $R^{28}$ has a hydroxy group and/or a carboxyl group as a substituent. It is preferable that one of $R^{27}$ and $R^{28}$ has a hydroxy group as a substituent and the other has an unsubstituted hydrocarbon group from the viewpoint of providing a good balance of electrical insulation, seizure resistance, and wear resistance.

Examples of the hydrocarbon group represented by $R^{27}$ and $R^{28}$ include an alkyl group having 2 to 20 carbons. In a case where the hydrocarbon group is unsubstituted, an alkyl group having 6 to 20 carbons or the like is preferable, and an alkyl group having 8 to 18 carbons is more preferable. In a case where a hydroxyl group and/or a carboxyl group is present as a substituent, an alkyl group having 2 to 6 carbons is preferable, and an alkyl group having 2 to 4 carbons is more preferable.

The content of the sulfur-containing compound in the lubricating oil composition is 10 ppm or more by mass and 2000 ppm or less by mass, preferably 100 ppm or more by mass and 2000 ppm or less by mass, more preferably 300 ppm or more by mass and 2000 ppm or less by mass, as an amount of sulfur on the basis of the total amount of the lubricating oil composition. When two or more of the sulfur-containing compound are contained, the total content thereof is within the above-mentioned numerical value ranges. When the content of the sulfur-containing compound is not less than the lower limits above, seizure resistance can be improved. When the content of the sulfur-containing compound is not more than the upper limits above, it is possible to improve electrical insulation. As used herein, the "amount of sulfur in the lubricating oil composition" means the value measured by inductively coupled plasma atomic emission spectrometry (intensity ratio method) in accordance with JPI-5S-38-2003.

[(E) Ashless Dispersant]

There is no special limitation to the ashless dispersant (hereinafter sometimes referred to as "Component (E)"), and for example, one or more compounds selected from the following Compounds (E-1) to (E-3) can be used.

(E-1) Succinimide having at least one alkyl or alkenyl group in the molecule or a derivative thereof (hereinafter sometimes referred to as "Component (E-1)").

(E-2) Benzylamine having at least one alkyl or alkenyl group in the molecule, or a derivative thereof (hereinafter referred to as "Component (E-2)").

(E-3) A polyamine having at least one alkyl or alkenyl group in the molecule, or a derivative thereof (hereinafter referred to as "Component (E-3)").

Component (E-1) can be particularly preferably used as Component (E).

Examples of the succinimide having at least one alkyl group or alkenyl group in the molecule among the Components (E-1) include compounds represented by the following general formula (7) or (8).

(7)

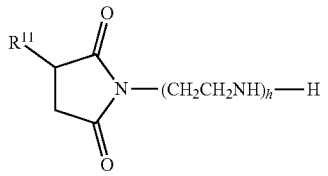

(8)

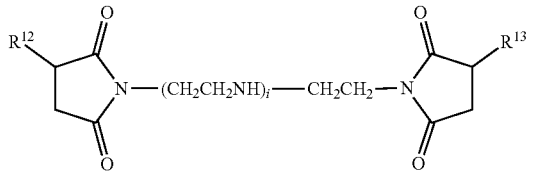

In general formula (7), $R^{11}$ represents an alkyl group or an alkenyl group, and h represents an integer of 1 to 5, preferably 2 to 4. $R^{11}$ preferably has 60 or more carbons and preferably 350 or less carbons.

In general formula (8), $R^{12}$ and $R^{13}$ each independently represent an alkyl group or an alkenyl group, and may be a combination of different groups. $R^{12}$ and $R^{13}$ are particularly preferably a polybutenyl group. i indicates an integer from 0 to 4 and preferably from 1 to 3. The number of carbons of $R^{12}$ and $R^{13}$ is preferably 60 or more and preferably 350 or less.

When the number of carbons of $R^{12}$ and $R^{13}$ in general formulae (7) and (8) is equal to or greater than the lower limit, good solubility in the lubricant base oil can be obtained. On the other hand, when the number of carbons of $R^{11}$ to $R^{13}$ is equal to or less than the upper limit, the low-temperature fluidity of the lubricating oil composition can be improved.

The alkyl or alkenyl group ($R^{11}$ to $R^{13}$) in general formulae (7) and (8) may be linear or branched, and preferred examples include branched alkyl groups and branched alkenyl groups derived from oligomers of olefins such as propylene, 1-butene, isobutene, and co-oligomers of ethylene and propylene. Most preferred among these are branched alkyl groups or alkenyl groups derived from oligomers of isobutene commonly referred to as polyisobutylene, and polybutenyl groups.

The number average molecular weight of the alkyl group or the alkenyl group ($R^{11}$ to $R^{13}$) in general formulae (7) and (8) is preferably 800 to 3500.

The succinimide having at least one alkyl or alkenyl group in the molecule encompasses the so-called mono-type succinimide represented by general formula (7) to which succinic anhydride is added to only one end of the polyamine chain and the so-called bis-type succinimide represented by general formula (8) to which succinic anhydride is added to both ends of the polyamine chain. The lubricating oil composition of the present invention may include either the mono-type or the bis-type succinimide, or may include both as a mixture.

A method for producing a succinimide having at least one alkyl group or alkenyl group in a molecule is not particularly limited, and for example, it can be obtained by reacting an alkyl succinic acid or an alkenyl succinic acid obtained by reacting a compound having an alkyl group or an alkenyl group having 40 to 400 carbons with maleic anhydride at 100 to 200° C. with a polyamine. Examples of the polyamine include diethylenetriamine, triethylenetetramine, tetraethylenepentamine, and pentaethylenehexamine.

As the benzylamine having at least one alkyl group or alkenyl group in the molecule among the Components (E-2), a compound represented by the following general formula (9) can be exemplified.

(9)

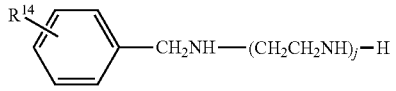

In general formula (9), $R^{14}$ represents an alkyl group or alkenyl group having 40 to 400 carbons, and j represents an integer of 1 to 5, preferably 2 to 4. $R^{14}$ preferably has 60 or more carbons and preferably 350 or less carbons.

The manufacturing method of the Component (E-2) is not particularly limited. For example, there is a method in which a polyolefin such as a propylene oligomer, polybutene, or an ethylene-α-olefin copolymer is reacted with phenol to produce an alkyl phenol, and then formaldehyde is reacted with a polyamine such as diethylenetriamine, triethylenetetramine, tetraethylenepentamine, or pentaethylenehexamine by a Mannich reaction.

As the polyamine having at least one alkyl group or alkenyl group in the molecule among Components (E-3), a compound represented by the following formula (10) can be exemplified.

$$R^{15}—NH—(CH_2CH_2NH)_k—H \quad (10)$$

In formula (10), $R^{15}$ represents an alkyl group or alkenyl group having 40 to 400 carbons, and k represents an integer of 1 to 5, preferably 2 to 4. $R^{15}$ preferably has 60 or more carbons and preferably 350 or less.

The manufacturing method of Component (E-3) is not particularly limited. For example, there is a method in which a polyolefin such as a propylene oligomer, polybutene, or an ethylene-α-olefin copolymer is chlorinated and then reacted with ammonia or a polyamine such as ethylenediamine, diethylenetriamine, triethylenetetramine, tetraethylenepentamine, or pentaethylenehexamine.

Examples of the derivatives of Components (E-1) to (E-3) include, for example, (i) a modified compound by a nitrogen-containing organic compound which is obtained by acting the succinimide, benzylamine or polyamine having at least one alkyl group or alkenyl group in the molecule as mentioned above (hereinafter referred to as "the above-described nitrogen-containing compound") with a monocarboxylic acid having 1 to 30 carbons such as a fatty acid, and a polycarboxylic acid having 2 to 30 carbons (for example, oxalic acid, phthalic acid, trimellitic acid, pyromellitic acid, and the like), an anhydride or an ester compound thereof, an alkylene oxide having 2 to 6 carbons, or hydroxyl(poly) oxyalkylene carbonate, whereby a part or all of the residual amino groups and/or imino groups is neutralized or amidated; (ii) a boron-modified compound in which a part or all of the residual amino groups and/or imino groups is neutralized or amidated by acting the above-mentioned nitrogen-containing compound with a boric acid; (iii) a phosphoric acid-modified compound in which a part or all of the residual amino groups and/or imino groups is neutralized or amidated by acting the above-mentioned nitrogen-containing compound with a phosphoric acid; (iv) a sulfur-modified compound obtained by acting the above-mentioned nitrogen-containing compound with a sulfur compound; and (v) a modified compound obtained by treating the above-mentioned nitrogen-containing compound with two or more modifications selected from modification by a nitrogen-containing compound, boron modification, phosphoric acid modification, sulfur modification. It is possible to further improve electrical insulation by using a boric acid-modified compound of alkenyl succinimide among the derivatives of (i) to (v).

The molecular weight of Component (E) is not particularly limited, and the weight average molecular weight of Component (E-1) is preferably 1000 or more and 20000 or less, more preferably 2000 or more and 10000 or less.

The content of Component (E) is 0.010% or more by mass and 4.0% or less by mass, preferably 0.050% or more by mass and 3.5% or less by mass, more preferably 0.10% or more by mass and 3.0% or less by mass, and further preferably 0.30% or more by mass and 2.5% or less by mass, on the basis of the total amount of the lubricating oil composition. When the content of Component (E) is not less than the above-mentioned lower limit, seizure resistance of the lubricating oil composition can be further improved. When the content of Component (E) is not more than the above-mentioned upper limit, electric insulation of the lubricating oil composition can be further improved.

[(F) Phosphorus-Based Compound]

As for the phosphorus-based compound, a phosphorus-based compound commonly used as an anti-wear agent for a lubricating oil can be used. Specific examples of the phosphorus-based compound include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metal salts thereof, and derivatives thereof.

For example, a phosphorus-based compound represented by general formula (11) or (12) or an amine salt thereof can be used.

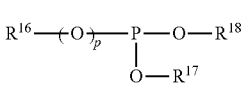

(11)

In general formula (11), $R^{16}$ is a monovalent hydrocarbon group having 1 to 30 carbons, which may contain O or S, $R^{17}$ and $R^{18}$ are each independently a hydrogen atom or a monovalent hydrocarbon group having 1 to 30 carbons, which may contain O or S, and p is 0 or 1.

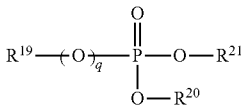

(12)

In general formula (12), $R^{19}$ is a monovalent hydrocarbon group having 1 to 30 carbons, which may contain O or S, $R^{20}$ and $R^{21}$ are independently hydrogen atoms or a monovalent hydrocarbon group having 1 to 30 carbons, which may contain O or S, and q is 0 or 1.

In the above general formulae (11) and (12), examples of the monovalent hydrocarbon group represented by $R^{16}$ to $R^{21}$ having 1 to 30 carbons and optionally containing 0 or S include an alkyl group, a cycloalkyl group, an alkenyl group, an alkyl-substituted cycloalkyl group, an aryl group, an alkyl-substituted aryl group, an arylalkyl group, an oxaalkyl group, and a thiaalkyl group. Particularly, it is preferably an alkyl group having 1 to 30 carbons or an aryl group having 6 to 24 carbons, more preferably an alkyl group having 3 to 18 carbons, and most preferably an alkyl group having 4 to 15 carbons.

Examples of the phosphorus-based compound represented by the above general formula (11) include the phosphite monoester and (hydrocarbyl) phosphonous acid having one hydrocarbon group having 1 to 30 carbons; the phosphite diester having two hydrocarbon groups having 1 to 30 carbons and (hydrocarbyl) phosphonous acid monoester; the phosphite triester having three hydrocarbon groups having 1 to 30 carbons and (hydrocarbyl)phosphonous acid diester; and mixtures thereof.

The acidic phosphite ester wherein $R^{17}$ and $R^{18}$ are both hydrogen atoms in the above general formula (11), and the acidic phosphate ester wherein $R^{20}$ and/or $R^{21}$ are hydrogen atoms in the above general formula (12) may be a salt with an amine represented by general formula (13).

$$R^{22}_{3-r}NH_r \quad (13)$$

In the above general formula (13), $R^{22}$ each independently represents a monovalent hydrocarbon group having 1 to 30 carbons, and r represents 1 or 2.

In the above general formula (13), examples of the monovalent hydrocarbon group having 1 to 30 carbons represented by $R^{22}$ include an alkyl group, a cycloalkyl group, an alkenyl group, an alkyl-substituted cycloalkyl group, an aryl group, an alkyl-substituted aryl group, and an arylalkyl group. In particular, an alkyl group having 1 to 30 carbons or an aryl group having 6 to 24 carbons is preferable, and an alkyl group having 6 to 18 carbons is more preferable.

Zinc dialkyldithiophosphate (ZnDTP) represented by the following general formula (14) can also be used.

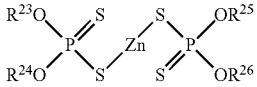

(14)

In general formula (14), $R^{23}$ to $R^{26}$ each independently represents a linear or branched alkyl group having 1 to 24 carbons, and may be a combination of different groups. $R^{23}$ to $R^{26}$ preferably have 3 to 12 carbons, more preferably 3 to 8 carbons. $R^{23}$ to $R^{26}$ may be any of a primary alkyl group, a secondary alkyl group, and a tertiary alkyl group, and preferably a primary alkyl group, a secondary alkyl group, or a combination thereof, and further, the molar ratio of the primary alkyl group to the secondary alkyl group (primary alkyl group:secondary alkyl group) is preferably 100:0 to 70:30. This ratio may be a combination ratio of alkyl groups in the molecule, or may be a mixture ratio of ZnDTP having only a primary alkyl group and ZnDTP having only a secondary alkyl group. The thermal/oxidative stability can be improved since the primary alkyl group is the main component.

The method for producing the zinc dialkyldithiophosphate is not particularly limited. For example, the zinc dialkyldithiophosphate can be synthesized by reacting an alcohol having an alkyl group corresponding to $R^{23}$ to $R^{26}$ with diphosphorus pentasulfide to synthesize dithiophosphate, and neutralizing the dithiophosphate with zinc oxide.

The content of the phosphorus-based compound is preferably 0.1% or more by mass and 5.0% or less by mass, more preferably 0.2% or more by mass and 3.0% or less by mass, on the basis of the total amount of the lubricating oil composition. When the content of the phosphorus-based compound is within the above-mentioned numerical ranges, wear resistance can be further improved.

[(G) Antioxidant]

The antioxidant is not particularly limited, and compounds commonly used as antioxidants for lubricating oils can be used. Examples of the antioxidant include an amine-based antioxidant and a phenol-based antioxidant, and the like. Known amine antioxidants can be used for the amine-based antioxidant, for example, alkylated diphenylamine, alkylated phenyl-α-naphthylamine, phenyl-α-naphthylamine, and phenyl-β-naphthylamine, and the like. Known phenolic antioxidants can be used for the phenol-based antioxidant, for example, 2,6-di-tert-butyl-4-methylphenol (DBPC) and 4,4'-methylenebis (2,6-di-tert-butylphenol), and the like.

The content of the antioxidant is preferably 0.01% or more by mass and 5% or less by mass, more preferably 0.1% or more by mass and 3% or less by mass, on the basis of the total amount of the lubricating oil composition. When the content of the antioxidant is within the above-mentioned numerical ranges, a sufficient anti-oxidation effect can be obtained.

[Other Components]

In addition to the above-described components (A) to (G), the lubricating oil composition may further include other components commonly used in lubricating oil compositions, such as a thickener, a rust inhibitor, a pour point depressant, a demulsifier, a metal deactivator and an antifoaming agent.

As the thickener, known thickeners used in a lubricating oil can be used without particular limitation. Examples thereof include polymethacrylate, ethylene-α-olefin copolymer and a hydride thereof, copolymer of α-olefin and ester monomer having a polymerizable unsaturated bond, polyisobutylene and a hydride thereof, hydride of styrene-diene copolymer, styrene-maleic anhydride ester copolymer, and polyalkylstyrene, and the like. Among these, polymethacrylate, or ethylene-α-olefin copolymer or a hydride thereof, or a combination thereof can be preferably used. The thickener may be dispersant type or non-dispersant type thickener. The weight average molecular weight of the thickener may be, for example, 2000 to 30000. The lubricating oil composition may be free of a thickener; however when the lubricating oil contains a thickener, the content of the thickener is preferably 0.01% or more by mass and 12% or less by mass, more preferably 0.05% or less by mass and 8% or less by mass, on the basis of the total amount of the lubricating oil composition.

The rust inhibitor includes, for example, petroleum sulfonate, alkylbenzene sulfonate, dinonylnaphthalene sulfonate, alkenyl succinic acid ester, and polyhydric alcohol ester. The lubricating oil composition may be free of a rust inhibitor; however, when the lubricating oil composition contains a rust inhibitor, the content is preferably 0.01% or more by mass and 1% or less by mass, more preferably 0.05% or more by mass and 0.5% or less by mass, on the basis of the total amount of the lubricating oil composition.

As the pour point depressant, for example, a polymethacrylate polymer suitable for the lubricant base oil to be used. The lubricating oil composition may be free of a pour point depressant; however, when the lubricating oil composition contains a pour point depressant, the content is preferably 0.01% by mass and 1% or less by mass, more preferably 0.05% by mass and 0.5% or less by mass, on the basis of the total amount of the lubricating oil composition.

Examples of the demulsifier include polyalkylene glycol nonionic surfactants such as polyoxyethylene alkyl ether, polyoxyethylene alkyl phenyl ether, and polyoxyethylene alkyl naphthyl ether. The lubricating oil composition may be free of a demulsifier; however, when the lubricating oil composition contains a demulsifier, the content is preferably 0.01% or more by mass and 5% or less by mass, more preferably 0.05% or more by mass and 3% or less by mass, on the basis of the total amount of the lubricating oil composition.

Examples of the metal deactivator include imidazoline, pyrimidine derivative, alkylthiadiazole, mercaptobenzothiazole, 1,3,4-thiadiazole polysulfide, 1,3,4-thiadiazolyl-2,5-bisdialkyldithiocarbamate, 2-(alkyldithio)benzimidazole, β-(o-carboxybenzylthio)propionnitrile, and the like. The lubricating oil composition may be free of a metal deactivator; however when the lubricating oil composition contains a metal deactivator, the content is preferably 0.01% by mass and 1% or less by mass, more preferably 0.05% by mass and 0.5% or less by mass, on the basis of the total amount of the lubricating oil composition.

Examples of the antifoaming agent include silicone oil having a kinematic viscosity of 1,000 to 1,000,000 $mm^2/s$ at 25° C., alkenyl succinic acid derivative, ester of polyhydroxy aliphatic alcohol and long-chain fatty acid, methyl salicylate, and o-hydroxybenzyl alcohol. The lubricating oil composition may be free of an antifoaming agent; however, when the lubricating oil composition contains an antifoaming agent, the content of the antifoaming agent is preferably 0.0001% or more by mass and 0.5% or less by mass, more preferably 0.0005% or more by mass and 0.1% or less by mass, on the basis of the total amount of the lubricating oil composition.

[Properties of Lubricating Oil Composition]

The kinematic viscosity of the lubricating oil composition at 100° C. is preferably 1.8 $mm^2/s$ or more and 10.0 $mm^2/s$ or less, more preferably 2.3 $mm^2/s$ or more and 9.0 $mm^2/s$ or less, further preferably 3.0 $mm^2/s$ or more and 8.0 $mm^2/s$ or less, and further more preferably 4.1 $mm^2/s$ or more and 7.0 $mm^2/s$ or less. When the kinematic viscosity at 100° C. of the lubricating oil composition is within the above-mentioned numerical ranges, low-temperature viscosity characteristic improves, sufficient fuel efficiency is obtained, and oil film formation at the lubrication portion is satisfactorily performed to make the lubricity excellent.

The kinematic viscosity of the lubricating oil composition at 40° C. is preferably 5.0 $mm^2/s$ or more and 70.0 $mm^2/s$ or less, more preferably 7.0 $mm^2/s$ or more and 60.0 $mm^2/s$ or less, further preferably 10.0 $mm^2/s$ or more and 50.0 $mm^2/s$ or less, and further more preferably 20.0 $mm^2/s$ or more and 40.0 $mm^2/s$ or less. When the kinematic viscosity at 40° C. of the lubricating oil composition is within the above numerical ranges, low-temperature viscosity characteristic improves, and sufficient fuel efficiency is obtained, and oil film formation at the lubrication portion is satisfactorily performed to make the lubricity excellent.

The viscosity index of the lubricating oil composition is preferably 120 or more, more preferably 130 or more, further preferably 140 or more, and may be usually 250 or less. When the viscosity index of the lubricating oil composition is within the above-described numerical ranges, low-temperature viscosity characteristic improves, sufficient fuel efficiency is obtained, and oil film formation at the lubrication portion is satisfactorily performed to make the lubricity excellent.

The content of sulfur in the lubricating oil composition is preferably 0.05% or more by mass and 1.0% or less by mass, more preferably 0.01% or more by mass and 0.5% or less by mass, on the basis of the total amount of the lubricating oil composition. When the content of sulfur in the lubricating oil composition is within the above-mentioned numerical ranges, heat/oxidation stability can be improved.

[Lubricating Method]

The present invention also relates to a method for lubricating a power train of a hybrid or an electric vehicle using the above-described lubricating oil composition. In the present invention, the performance of the power train during use can be improved by using a lubricating oil composition having good electrical insulation, seizure resistance, and wear resistance.

Examples

The present invention will be specifically described below with reference to the Examples and Comparative Examples; however, the present invention is not limited to these Examples.

[Preparation of Lubricating Oil Composition]

Lubricating oil compositions of the present invention (Examples 1 to 31) and comparative lubricating oil compositions (Comparative Examples 1 to 10) were prepared by using the following lubricant base oils and various additives in the formulations described in Tables 1, 3, 5, and 7. In Tables 1, 3, 5, and 7, "in mass %" represents % by mass based on the total amount of the lubricant base oil, "mass %" represents % by mass on the basis of the total amount of the lubricating oil composition, and "mass ppm" represents ppm by mass on the basis of the total amount of the lubricating oil composition.

[(A) Lubricant Base Oil]

A-1: Hydrocracking base oil (Group II, Density (15° C.): 0.837, Kinematic Viscosity (40° C.): 12.7 $mm^2/s$, Kinematic Viscosity (100° C.): 3.1 $mm^2/s$, Viscosity Index: 104, Pour Point: −35° C., Sulfur Content: less than 1 ppm by mass)

A-2: Hydrocracking base oil (Group II, Density (15° C.): 0.834, Kinematic Viscosity (40° C.): 19.6 $mm^2/s$, Kinematic Viscosity (100° C.): 4.2 $mm^2/s$, Viscosity Index: 122, Pour Point: −15° C., Sulfur Content: less than 1 ppm by mass)

A-3: GTL wax isomerization base oil (Group III, Density (15° C.): 0.817, Kinematic Viscosity (40° C.): 18.2 $mm^2/s$, Kinematic Viscosity (100° C.): 4.1 $mm^2/s$, Viscosity Index: 130, Pour Point: −35° C., Sulfur Content: less than 1 ppm by mass)

A-4: Poly-α-olefin base oil (Group IV, Density (15° C.): 0.820, Kinematic Viscosity (40° C.): 18.4 $mm^2/s$, Kinematic Viscosity (100° C.): 4.1 $mm^2/s$, Viscosity Index: 126, Pour Point: −66° C.)

A-5: Monoester base oil (2-ethylhexyl oleate, Group V, Density (15° C.): 0.871, Kinematic Viscosity (40° C.): 8.4 $mm^2/s$, Kinematic Viscosity (100° C.): 2.7 $mm^2/s$, Viscosity Index: 181, Pour Point: −35° C.)

The amount of the lubricant base oil is 100% by mass of the total amount of the lubricating oil composition, and is the balance obtained by subtracting each additive.

[Additive]

[(B) Alkaline Earth Metal Detergent]

B-1: calcium sulfonate (Ca content: 15.5 mass %, S content: 1.26 mass %, total base number: 400 mg KOH/g)

B-2: calcium sulfonate (Ca content: 18.4 mass %, S content: 1.24 mass %, total base number: 500 mg KOH/g)

B-3: calcium sulfonate (Ca content: 11.6 mass %, S content: 1.6 mass %, total base number: 300 mg KOH/g)

B-4: calcium sulfonate (Ca content: 2.4 mass %, S content: 2.70 mass %, total base number: 17 mg KOH/g)

B-5: calcium sulfonate (Ca content: 2.5 mass %, S content: 3.22 mass %, total base number: 13 mg KOH/g)

B-6: calcium sulfonate (Ca content: 1.8 mass %, S content: 2.28 mass %, total base number: 0 mg KOH/g)

B-7: magnesium sulfonate (Mg content: 9.4 mass %, S content: 2 mass %, total base number: 400 mg KOH/g)

B-8: calcium salicylate (Ca content: 2.3 mass %, total base number: 64 mg KOH/g)

B-9: calcium phenate (Ca content: 5.6 mass %, total base number: 154 mg KOH/g)

[(C) Triazole-Based Compound]

C-1: N,N-bis(2-ethylhexyl)-(4 or 5)-methyl-1H-benzotriazol-1-methylamine (in general formula (1), $R^1$ is a methyl group, $R^2$ is a 2-ethylhexyl group, and $R^3$ is a 2-ethylhexyl group)

C-2: 1-[N,N-bis(2-ethylhexyl)aminomethyl]-benzotriazole (in general formula (1), $R^1$ is a hydrogen atom, $R^2$ is a 2-ethylhexyl group, and $R^3$ is a 2-ethylhexyl group)

C-3: 1-[(2-ethylhexyl) aminomethyl]-benzotriazole (in general formula (1), $R^1$ is a hydrogen atom, $R^2$ is a hydrogen atom, and $R^3$ is a 2-ethylhexyl group)

C-4: N,N-bis(2-ethylhexyl)-[(1,2,4-triazol-1-yl) methyl] amine (in general formula (2), $R^4$ is a hydrogen atom, $R^5$ is a 2-ethylhexyl group, and $R^6$ is a 2-ethylhexyl group)

C-5: tolyltriazole (CAS No. 29385-43-1)

C-6: 1,2,3-benzotriazole

[(D) Sulfur-Containing Compound]

D-1: polyisobutylene sulfolane ether (S content: 11.5 mass %)

D-2: 3-(dodecylthio) propanol

D-3: 3-(dodecylthio) propionic acid

[(E) Ashless Dispersant]

E-1: Boronized succinimide ashless dispersant (Mw: 4200)

E-2: Non-boronized succinimide ashless dispersant (M 4500)

[(F) Phosphorus-Based Compound]

F-1 Dibutylphosphite (P content: 15.9%)

F-2: ZnDTP (a mixture of compounds represented by general formula (14), Zn content: 10.6%, S content: 20%, P content: 9.5%, a primary alkyl group having 4 carbons: a primary alkyl group having 5 carbons=80:20)

[(G) Antioxidant]

G-1: Amine antioxidant

G-2: Phenol antioxidant

[(FI) Other Additives]

H-1: Thickener (ethylene-α-olefin copolymer, Mw: 13000)

H-2: Antifoaming agent (poly dimethyl silicone)

[Properties of Lubricating Oil Composition]

Various properties of the lubricating oil compositions of Examples 1 to 31 and Comparative Examples 1 to 10 were measured as follows. The results of the measurement of the lubricating oil compositions are shown in Tables 2, 4, 6, and 8.

Kinematic Viscosity (40° C., 100° C.): Measured in accordance with JIS K 2283-2010.

Viscosity Index: Measured in accordance with JIS K 2283-2010.

Content of element components (Ca, Mg, P, B, S, Zn) in oil: JPI-5S-38-2003 (Strength Ratio Method).

TABLE 1

| | | Examples | | | | | | | | | |
|---|---|---|---|---|---|---|---|---|---|---|---|
| | | Ex. 1 | Ex. 2 | Ex. 3 | Ex. 4 | Ex. 5 | Ex. 6 | Ex. 7 | Ex. 8 | Ex. 9 | Ex. 10 |
| Formulations of Lubricating oil compositions | | | | | | | | | | | |
| A-1 | inmass % | 40 | 40 | 40 | 40 | 40 | 40 | 40 | 40 | 40 | 40 |
| A-2 | inmass % | 60 | 60 | 60 | 60 | 60 | 60 | 60 | 60 | 60 | 60 |
| A-3 | inmass % | — | — | — | — | — | — | — | — | — | — |
| A-4 | inmass % | — | — | — | — | — | — | — | — | — | — |
| A-5 | inmass % | — | — | — | — | — | — | — | — | — | — |
| B-1 | mass % | 0.07 | 0.04 | 0.30 | — | — | — | — | — | — | — |
| B-2 | mass % | — | — | — | 0.07 | — | — | — | — | — | — |
| B-3 | mass % | — | — | — | — | 0.11 | — | — | — | — | — |
| B-4 | mass % | — | — | — | — | — | 0.54 | — | — | — | — |
| B-5 | mass % | — | — | — | — | — | — | 0.50 | — | — | — |
| B-6 | mass % | — | — | — | — | — | — | — | 0.69 | — | — |
| B-7 | mass % | — | — | — | — | — | — | — | — | 0.13 | — |
| B-8 | mass % | — | — | — | — | — | — | — | — | — | 0.56 |
| B-9 | mass % | — | — | — | — | — | — | — | — | — | — |
| C-1 | mass % | 0.05 | 0.05 | 0.05 | 0.05 | 0.05 | 0.05 | 0.05 | 0.05 | 0.05 | 0.05 |
| C-2 | mass % | — | — | — | — | — | — | — | — | — | — |
| C-3 | mass % | — | — | — | — | — | — | — | — | — | — |
| C-4 | mass % | — | — | — | — | — | — | — | — | — | — |
| C-5 | mass % | — | — | — | — | — | — | — | — | — | — |
| C-6 | mass % | — | — | — | — | — | — | — | — | — | — |
| D-1 | mass % | 0.60 | 0.60 | 0.60 | 0.60 | 0.60 | 0.60 | 0.60 | 0.60 | 0.60 | 0.60 |
| D-2 | mass % | 0.50 | 0.50 | 0.50 | 0.50 | 0.50 | 0.50 | 0.50 | 0.50 | 0.50 | 0.50 |
| D-3 | mass % | — | — | — | — | — | — | — | — | — | — |
| E-1 | mass % | 0.5 | 0.5 | 0.5 | 0.5 | 0.5 | 0.5 | 0.5 | 0.5 | 0.5 | 0.5 |
| E-2 | mass % | — | — | — | — | — | — | — | — | — | — |
| F-1 | mass % | 0.25 | 0.25 | 0.25 | 0.25 | 0.25 | 0.25 | 0.25 | 0.25 | 0.25 | 0.25 |
| F-2 | mass % | — | — | — | — | — | — | — | — | — | — |
| G-1 | mass % | 0.5 | 0.5 | 0.5 | 0.5 | 0.5 | 0.5 | 0.5 | 0.5 | 0.5 | 0.5 |
| G-2 | mass % | 0.5 | 0.5 | 0.5 | 0.5 | 0.5 | 0.5 | 0.5 | 0.5 | 0.5 | 0.5 |
| H-1 | mass % | 3.0 | 3.0 | 3.0 | 3.0 | 3.0 | 3.0 | 3.0 | 3.0 | 3.0 | 3.0 |
| H-2 | mass % | 0.003 | 0.003 | 0.003 | 0.003 | 0.003 | 0.003 | 0.003 | 0.003 | 0.003 | 0.003 |

TABLE 2

| | | Examples | | | | | | | | | |
|---|---|---|---|---|---|---|---|---|---|---|---|
| | | Ex. 1 | Ex. 2 | Ex. 3 | Ex. 4 | Ex. 5 | Ex. 6 | Ex. 7 | Ex. 8 | Ex. 9 | Ex. 10 |
| Properties of Lubricant base oil | | | | | | | | | | | |
| Kinematic Viscosity(100° C.) | $mm^2/s$ | 3.7 | 3.7 | 3.7 | 3.7 | 3.7 | 3.7 | 3.7 | 3.7 | 3.7 | 3.7 |
| Properties of Lubricating Oil Composition | | | | | | | | | | | |
| Kinematic Viscosity(40° C.) | $mm^2/s$ | 25.0 | 25.0 | 25.0 | 25.0 | 25.0 | 25.0 | 25.0 | 25.0 | 25.0 | 25.0 |
| Kinematic Viscosity(100° C.) | $mm^2/s$ | 5.2 | 5.2 | 5.2 | 5.2 | 5.2 | 5.2 | 5.2 | 5.2 | 5.2 | 5.2 |
| Viscosity Index | | 154 | 154 | 154 | 154 | 154 | 154 | 154 | 154 | 154 | 154 |
| Ca | massppm | 110 | 50 | 470 | 130 | 130 | 130 | 130 | 130 | — | 130 |
| Mg | massppm | — | — | — | — | — | — | — | — | 120 | — |
| S | mass % | 0.13 | 0.13 | 0.13 | 0.13 | 0.13 | 0.13 | 0.13 | 0.13 | 0.13 | 0.13 |

TABLE 2-continued

| | | Examples | | | | | | | | | |
|---|---|---|---|---|---|---|---|---|---|---|---|
| | | Ex. 1 | Ex. 2 | Ex. 3 | Ex. 4 | Ex. 5 | Ex. 6 | Ex. 7 | Ex. 8 | Ex. 9 | Ex. 10 |
| S derived from D1 component | massppm | 690 | 690 | 690 | 690 | 690 | 690 | 690 | 690 | 690 | 690 |
| S derived from D2 component | massppm | 620 | 620 | 620 | 620 | 620 | 620 | 620 | 620 | 620 | 620 |
| P | massppm | 400 | 400 | 400 | 400 | 400 | 400 | 400 | 400 | 400 | 400 |
| B | massppm | 100 | 100 | 100 | 100 | 100 | 100 | 100 | 100 | 100 | 100 |
| Zn | massppm | — | — | — | — | — | — | — | — | — | — |

TABLE 3

| | | Examples | | | | | | | | | |
|---|---|---|---|---|---|---|---|---|---|---|---|
| | | Ex. 11 | Ex. 12 | Ex. 13 | Ex. 14 | Ex. 15 | Ex. 16 | Ex. 17 | Ex. 18 | Ex. 19 | Ex. 20 |
| A-1 | inmass % | 40 | 40 | 40 | 40 | 40 | 40 | 40 | 40 | 40 | — |
| A-2 | inmass % | 60 | 60 | 60 | 60 | 60 | 60 | 60 | 60 | 60 | — |
| A-3 | inmass % | — | — | — | — | — | — | — | — | — | 100 |
| A-4 | inmass % | — | — | — | — | — | — | — | — | — | — |
| A-5 | inmass % | — | — | — | — | — | — | — | — | — | — |
| B-1 | mass % | — | 0.07 | 0.07 | 0.07 | 0.07 | 0.07 | 0.07 | 0.07 | — | 0.07 |
| B-2 | mass % | — | — | — | — | — | — | — | — | 0.07 | — |
| B-3 | mass % | — | — | — | — | — | — | — | — | — | — |
| B-4 | mass % | — | — | — | — | — | — | — | — | — | — |
| B-5 | mass % | — | — | — | — | — | — | — | — | — | — |
| B-6 | mass % | — | — | — | — | — | — | — | — | — | — |
| B-7 | mass % | — | — | — | — | — | — | — | — | — | — |
| B-8 | mass % | — | — | — | — | — | — | — | — | — | — |
| B-9 | mass % | 0.2 | — | — | — | — | — | — | — | — | — |
| C-1 | mass % | 0.05 | 0.01 | 0.15 | — | — | — | 0.05 | 0.05 | 0.05 | 0.05 |
| C-2 | mass % | — | — | — | 0.05 | — | — | — | — | — | — |
| C-3 | mass % | — | — | — | — | 0.05 | — | — | — | — | — |
| C-4 | mass % | — | — | — | — | — | 0.05 | — | — | — | — |
| C-5 | mass % | — | — | — | — | — | — | — | — | — | — |
| C-6 | mass % | — | — | — | — | — | — | — | — | — | — |
| D-1 | mass % | 0.60 | 0.60 | 0.60 | 0.60 | 0.60 | 0.60 | 0.03 | 1.20 | 0.60 | 0.60 |
| D-2 | mass % | 0.50 | 0.50 | 0.50 | 0.50 | 0.50 | 0.50 | 0.50 | 0.40 | 0.50 | 0.50 |
| D-3 | mass % | — | — | — | — | — | — | — | — | — | — |
| E-1 | mass % | 0.5 | 0.5 | 0.5 | 0.5 | 0.5 | 0.5 | 0.5 | 0.5 | 0.5 | 0.5 |
| E-2 | mass % | — | — | — | — | — | — | — | — | — | — |
| F-1 | mass % | 0.25 | 0.25 | 0.25 | 0.25 | 0.25 | 0.25 | 0.25 | 0.25 | — | 0.25 |
| F-2 | mass % | — | — | — | — | — | — | — | — | 1.40 | — |
| G-1 | mass % | 0.5 | 0.5 | 0.5 | 0.5 | 0.5 | 0.5 | 0.5 | 0.5 | 0.5 | 0.5 |
| G-2 | mass % | 0.5 | 0.5 | 0.5 | 0.5 | 0.5 | 0.5 | 0.5 | 0.5 | 0.5 | 0.5 |
| H-1 | mass % | 3.0 | 3.0 | 3.0 | 3.0 | 3.0 | 3.0 | 3.0 | 3.0 | 3.0 | 3.0 |
| H-2 | mass % | 0.003 | 0.003 | 0.003 | 0.003 | 0.003 | 0.003 | 0.003 | 0.003 | 0.003 | 0.003 |

TABLE 4

| | | Examples | | | | | | | | | |
|---|---|---|---|---|---|---|---|---|---|---|---|
| | | Ex. 11 | Ex. 12 | Ex. 13 | Ex. 14 | Ex. 15 | Ex. 16 | Ex. 17 | Ex. 18 | Ex. 19 | Ex. 20 |
| Properties of Lubricant base oil | | | | | | | | | | | |
| Kinematic Viscosity(100° C.) | $mm^2/s$ | 3.7 | 3.7 | 3.7 | 3.7 | 3.7 | 3.7 | 3.7 | 3.7 | 3.7 | 4.1 |
| Properties of Lubricating Oil Composition | | | | | | | | | | | |
| Kinematic Viscosity(40° C.) | $mm^2/s$ | 25.0 | 25.0 | 25.0 | 25.0 | 25.0 | 25.0 | 25.0 | 25.0 | 25.0 | 27.0 |
| Kinematic Viscosity(100° C.) | $mm^2/s$ | 5.2 | 5.2 | 5.2 | 5.2 | 5.2 | 5.2 | 5.2 | 5.2 | 5.2 | 5.6 |
| Viscosity Index | | 154 | 154 | 154 | 154 | 154 | 154 | 154 | 154 | 154 | 154 |
| Ca | massppm | 110 | 110 | 110 | 110 | 110 | 110 | 110 | 110 | 130 | 110 |
| Mg | massppm | — | — | — | — | — | — | — | — | — | — |
| S | mass % | 0.13 | 0.13 | 0.13 | 0.13 | 0.13 | 0.13 | 0.07 | 0.19 | 0.41 | 0.13 |

TABLE 4-continued

| | | Examples | | | | | | | | | |
|---|---|---|---|---|---|---|---|---|---|---|---|
| | | Ex. 11 | Ex. 12 | Ex. 13 | Ex. 14 | Ex. 15 | Ex. 16 | Ex. 17 | Ex. 18 | Ex. 19 | Ex. 20 |
| S derived from D1 component | massppm | 690 | 690 | 690 | 690 | 690 | 690 | 40 | 1380 | 690 | 690 |
| S derived from D2 component | massppm | 620 | 620 | 620 | 620 | 620 | 620 | 620 | 496 | 620 | 620 |
| P | massppm | 400 | 400 | 400 | 400 | 400 | 400 | 400 | 400 | 1300 | 400 |
| B | massppm | 100 | 100 | 100 | 100 | 100 | 100 | 100 | 100 | 100 | 100 |
| Zn | massppm | — | — | — | — | — | — | — | — | 1400 | — |

TABLE 5

| | | Examples | | | | | | | | | | |
|---|---|---|---|---|---|---|---|---|---|---|---|---|
| | | Ex. 21 | Ex. 22 | Ex. 23 | Ex. 24 | Ex. 25 | Ex. 26 | Ex. 27 | Ex. 28 | Ex. 29 | Ex. 30 | Ex. 31 |
| A-1 | inmass % | — | — | 40 | 40 | 40 | 40 | 40 | 40 | 40 | 40 | 40 |
| A-2 | inmass % | — | 90 | 60 | 60 | 60 | 60 | 60 | 60 | 60 | 60 | 60 |
| A-3 | inmass % | — | — | — | — | — | — | — | — | — | — | — |
| A-4 | inmass % | 100 | — | — | — | — | — | — | — | — | — | — |
| A-5 | inmass % | — | 10 | — | — | — | — | — | — | — | — | — |
| B-1 | mass % | 0.07 | 0.07 | 0.07 | 0.07 | 0.07 | 0.06 | 0.06 | 0.06 | 0.06 | 0.06 | 0.06 |
| B-2 | mass % | — | — | — | — | — | — | — | — | — | — | — |
| B-3 | mass % | — | — | — | — | — | — | — | — | — | — | — |
| B-4 | mass % | — | — | — | — | — | — | — | — | — | — | — |
| B-5 | mass % | — | — | — | — | — | — | — | — | — | — | — |
| B-6 | mass % | — | — | — | — | — | — | — | — | — | — | — |
| B-7 | mass % | — | — | — | — | — | — | — | — | — | — | — |
| B-8 | mass % | — | — | — | — | — | — | — | — | — | — | — |
| B-9 | mass % | — | — | — | — | — | — | — | — | — | — | — |
| C-1 | mass % | 0.05 | 0.05 | 0.05 | 0.05 | 0.05 | 0.04 | 0.04 | 0.04 | 0.04 | 0.04 | 0.04 |
| C-2 | mass % | — | — | — | — | — | — | — | — | — | — | — |
| C-3 | mass % | — | — | — | — | — | — | — | — | — | — | — |
| C-4 | mass % | — | — | — | — | — | — | — | — | — | — | — |
| C-5 | mass % | — | — | — | — | — | — | — | — | — | — | — |
| C-6 | mass % | — | — | — | — | — | — | — | — | — | — | — |
| D-1 | mass % | 0.60 | 0.60 | 0.60 | 0.60 | 0.60 | 0.30 | 1.50 | — | — | 0.60 | 0.60 |
| D-2 | mass % | 0.50 | 0.50 | 0.50 | 0.50 | 0.50 | — | — | 1.00 | 1.50 | — | 0.50 |
| D-3 | mass % | — | — | — | — | — | — | — | — | — | 0.50 | — |
| E-1 | mass % | 0.5 | 0.5 | 3.0 | 0.1 | — | 0.5 | 0.5 | 0.5 | 0.5 | 0.5 | 0.5 |
| E-2 | mass % | — | — | — | — | 0.5 | — | — | — | — | — | — |
| F-1 | mass % | 0.25 | 0.25 | 0.25 | 0.15 | 0.25 | 0.25 | 0.25 | 0.25 | 0.25 | 0.25 | 0.25 |
| F-2 | mass % | — | — | — | — | — | — | — | — | — | — | — |
| G-1 | mass % | 0.5 | 0.5 | 0.5 | 0.5 | 0.5 | 0.5 | 0.5 | 0.5 | 0.5 | 0.5 | — |
| G-2 | mass % | 0.5 | 0.5 | 0.5 | 0.5 | 0.5 | 0.5 | 0.5 | 0.5 | 0.5 | 0.5 | — |
| H-1 | mass % | 3.0 | 3.0 | 3.0 | 3.0 | 3.0 | 3.0 | 3.0 | 3.0 | 3.0 | 3.0 | — |
| H-2 | mass % | 0.003 | 0.003 | 0.003 | 0.003 | 0.003 | 0.003 | 0.003 | 0.003 | 0.003 | 0.003 | — |

TABLE 6

| | | Examples | | | | | | | | | | |
|---|---|---|---|---|---|---|---|---|---|---|---|---|
| | | Ex. 21 | Ex. 22 | Ex. 23 | Ex. 24 | Ex. 25 | Ex. 26 | Ex. 27 | Ex. 28 | Ex. 29 | Ex. 30 | Ex. 31 |
| Properties of Lubricant base oil | | | | | | | | | | | | |
| Kinematic Viscosity(100° C.) | $mm^2/s$ | 4.1 | 4.0 | 3.7 | 3.7 | 3.7 | 3.7 | 3.7 | 3.7 | 3.7 | 3.7 | 3.7 |
| Properties of Lubricating Oil Composition | | | | | | | | | | | | |
| Kinematic Viscosity(40° C.) | $mm^2/s$ | 27.2 | 26.0 | 26.7 | 24.3 | 25.0 | 25.0 | 25.0 | 25.0 | 25.0 | 25.0 | 25.0 |
| Kinematic Viscosity(100° C.) | $mm^2/s$ | 5.6 | 5.5 | 5.6 | 5.2 | 5.2 | 5.2 | 5.2 | 5.2 | 5.2 | 5.2 | 5.2 |
| Viscosity Index | | 152 | 156 | 154 | 152 | 154 | 154 | 154 | 154 | 154 | 154 | 154 |
| Ca | massppm | 110 | 110 | 110 | 110 | 110 | 90 | 90 | 90 | 90 | 90 | 90 |
| Mg | massppm | — | — | — | — | — | — | — | — | — | — | — |
| S | mass % | 0.13 | 0.13 | 0.13 | 0.13 | 0.13 | 0.03 | 0.17 | 0.12 | 0.19 | 0.13 | 0.13 |

TABLE 6-continued

| | | Examples | | | | | | | | | | |
|---|---|---|---|---|---|---|---|---|---|---|---|---|
| | | Ex. 21 | Ex. 22 | Ex. 23 | Ex. 24 | Ex. 25 | Ex. 26 | Ex. 27 | Ex. 28 | Ex. 29 | Ex. 30 | Ex. 31 |
| S derived from D1 component | massppm | 690 | 690 | 690 | 690 | 690 | 345 | 1725 | — | — | 690 | 690 |
| S derived from D2, D3 component | massppm | 620 | 620 | 620 | 620 | 620 | — | — | 1241 | 1861 | 584 | 620 |
| P | massppm | 400 | 400 | 400 | 240 | 400 | 320 | 320 | 320 | 320 | 320 | 320 |
| B | massppm | 100 | 100 | 600 | 20 | — | 80 | 80 | 80 | 80 | 80 | 80 |
| Zn | massppm | — | — | — | — | — | — | — | — | — | — | — |

TABLE 7

| | | Comparative Examples | | | | | | | | | |
|---|---|---|---|---|---|---|---|---|---|---|---|
| | | Co. Ex. 1 | Co. Ex. 2 | Co. Ex. 3 | Co. Ex. 4 | Co. Ex. 5 | Co. Ex. 6 | Co. Ex. 7 | Co. Ex. 8 | Co. Ex. 9 | Co. Ex. 10 |
| Formulations of Lubricating oil compositions | | | | | | | | | | | |
| A-1 | inmass % | 40 | 40 | 40 | 40 | 40 | 40 | 40 | 40 | 40 | 40 |
| A-2 | inmass % | 60 | 60 | 60 | 60 | 60 | 60 | 60 | 60 | 60 | 60 |
| A-3 | inmass % | — | — | — | — | — | — | — | — | — | — |
| A-4 | inmass % | — | — | — | — | — | — | — | — | — | — |
| A-5 | inmass % | — | — | — | — | — | — | — | — | — | — |
| B-1 | mass % | — | 0.07 | 0.07 | 0.07 | 0.07 | 0.70 | 0.07 | 0.07 | 0.07 | 0.07 |
| B-2 | mass % | — | — | — | — | — | — | — | — | — | — |
| B-3 | mass % | — | — | — | — | — | — | — | — | — | — |
| B-4 | mass % | — | — | — | — | — | — | — | — | — | — |
| B-5 | mass % | — | — | — | — | — | — | — | — | — | — |
| B-6 | mass % | — | — | — | — | — | — | — | — | — | — |
| B-7 | mass % | — | — | — | — | — | — | — | — | — | — |
| B-8 | mass % | — | — | — | — | — | — | — | — | — | — |
| B-9 | mass % | — | — | — | — | — | — | — | — | — | — |
| C-1 | mass % | 0.05 | — | — | — | 0.05 | 0.05 | 1.00 | 0.05 | 0.05 | 0.05 |
| C-2 | mass % | — | — | — | — | — | — | — | — | — | — |
| C-3 | mass % | — | — | — | — | — | — | — | — | — | — |
| C-4 | mass % | — | — | — | — | — | — | — | — | — | — |
| C-5 | mass % | — | — | 0.05 | — | — | — | — | — | — | — |
| C-6 | mass % | — | — | — | 0.05 | — | — | — | — | — | — |
| D-1 | mass % | 0.60 | 0.60 | 0.60 | 0.60 | — | 0.60 | 0.60 | 4.50 | 0.60 | 0.60 |
| D-2 | mass % | 0.50 | 0.50 | 0.50 | 0.50 | — | 0.50 | 0.50 | 0.50 | 0.50 | 4.00 |
| D-3 | mass % | — | — | — | — | — | — | — | — | — | — |
| E-1 | mass % | 0.5 | 0.5 | 0.5 | 0.5 | 0.5 | 0.5 | 0.5 | 0.5 | 5.0 | 5.0 |
| E-2 | mass % | — | — | — | — | — | — | — | — | — | — |
| F-1 | mass % | 0.25 | 0.25 | 0.25 | 0.25 | 0.25 | 0.25 | 0.25 | 0.25 | 0.25 | 0.25 |
| F-2 | mass % | — | — | — | — | — | — | — | — | — | — |
| G-1 | mass % | 0.5 | 0.5 | 0.5 | 0.5 | 0.5 | 0.5 | 0.5 | 0.5 | 0.5 | 0.5 |
| G-2 | mass % | 0.5 | 0.5 | 0.5 | 0.5 | 0.5 | 0.5 | 0.5 | 0.5 | 0.5 | 0.5 |
| H-1 | mass % | 3.0 | 3.0 | 3.0 | 3.0 | 3.0 | 3.0 | 3.0 | 3.0 | 3.0 | 3.0 |
| H-2 | mass % | 0.003 | 0.003 | 0.003 | 0.003 | 0.003 | 0.003 | 0.003 | 0.003 | 0.003 | 0.003 |

TABLE 8

| | | Comparative Examples | | | | | | | | | |
|---|---|---|---|---|---|---|---|---|---|---|---|
| | | Co. Ex. 1 | Co. Ex. 2 | Co. Ex. 3 | Co. Ex. 4 | Co. Ex. 5 | Co. Ex. 6 | Co. Ex. 7 | Co. Ex. 8 | Co. Ex. 9 | Co. Ex. 10 |
| Properties of Lubricant base oil | | | | | | | | | | | |
| Kinematic Viscosity(100° C.) | $mm^2/s$ | 3.7 | 3.7 | 3.7 | 3.7 | 3.7 | 3.7 | 3.7 | 3.7 | 3.7 | 3.7 |
| Properties of Lubricating Oil Composition | | | | | | | | | | | |
| Kinematic Viscosity(40° C.) | $mm^2/s$ | 25.0 | 25.0 | 25.0 | 25.0 | 25.0 | 25.0 | 25.0 | 25.0 | 28.1 | 25.0 |
| Kinematic Viscosity(100° C.) | $mm^2/s$ | 5.2 | 5.2 | 5.2 | 5.2 | 5.2 | 5.2 | 5.2 | 5.2 | 5.8 | 5.2 |
| Viscosity Index | | 154 | 154 | 154 | 154 | 154 | 154 | 154 | 154 | 155 | 154 |
| Ca | massppm | — | 110 | 110 | 110 | 110 | 1090 | 110 | 110 | 110 | 110 |

TABLE 8-continued

| | | Comparative Examples | | | | | | | | | |
|---|---|---|---|---|---|---|---|---|---|---|---|
| | | Co. Ex. 1 | Co. Ex. 2 | Co. Ex. 3 | Co. Ex. 4 | Co. Ex. 5 | Co. Ex. 6 | Co. Ex. 7 | Co. Ex. 8 | Co. Ex. 9 | Co. Ex. 10 |
| Mg | massppm | — | — | — | — | — | — | — | — | — | |
| S | mass % | 0.13 | 0.13 | 0.13 | 0.13 | 0.00 | 0.13 | 0.13 | 0.58 | 0.13 | 0.57 |
| S derived from D1 component | massppm | 690 | 690 | 690 | 690 | — | 690 | 690 | 5175 | 690 | 690 |
| S derived from D2 component | massppm | 620 | 620 | 620 | 620 | — | 620 | 620 | 620 | 620 | 4963 |
| P | massppm | 400 | 400 | 400 | 400 | 400 | 400 | 400 | 400 | 400 | 400 |
| B | massppm | 100 | 100 | 100 | 100 | 100 | 100 | 100 | 100 | 1000 | 1000 |
| Zn | massppm | — | — | — | — | — | — | — | — | — | |

[Performance Evaluation of Lubricating Oil Composition]

The following performance lubricating oil compositions of Examples 1 to 31 and Comparative Examples 1 to 10 was subjected to the following performance evaluation. The results of the evaluation are shown in Tables 9 to 12.

[Evaluation of Electrical Insulation]

(Measurement of Relative Dielectric Constant)

Relative dielectric constants of the lubricating oil compositions were measured at 25° C. in accordance with JIS C2101. The lower the relative dielectric constant indicates the better the electrical insulation.

[Evaluation of Seizure Resistance]

(High-Speed Four Ball Test 1)

The lubricating oil composition was subjected to a high-speed four ball test in accordance with ASTM D2783, and the last non-seizure load (LNSL) (N) was measured at a rotational speed of 1500 rpm. The higher the LNSL indicates the better the seizure resistance.

[Evaluation of Wear Resistance]

(High-Speed Four Ball Test 2)

The lubricating oil composition was subjected to a high-speed four ball test in accordance with ASTM D 4172, and the wear scar diameter (mm) was measured after one hour operation at a rotational speed of 1500 rpm and a load of 392N. The smaller the wear scar diameter indicates the better the wear resistance.

TABLE 9

| Performance Evaluation of Lubricating Oil Composition | | Examples | | | | | | | | | |
|---|---|---|---|---|---|---|---|---|---|---|---|
| | | Ex. 1 | Ex. 2 | Ex. 3 | Ex. 4 | Ex. 5 | Ex. 6 | Ex. 7 | Ex. 8 | Ex. 9 | Ex. 10 |
| Relative Dielectric Constant | | 2.2 | 2.1 | 2.4 | 2.2 | 2.2 | 2.2 | 2.2 | 2.2 | 2.2 | 2.9 |
| High-speed Four Ball Test 1 | N | 785 | 618 | 981 | 785 | 785 | 785 | 618 | 785 | 785 | 785 |
| High-speed Four Ball Test 2 | mm | 0.55 | 0.56 | 0.54 | 0.55 | 0.55 | 0.57 | 0.60 | 0.58 | 0.55 | 0.55 |

TABLE 10

| Performance Evaluation of Lubricating Oil Composition | | Examples | | | | | | | | | |
|---|---|---|---|---|---|---|---|---|---|---|---|
| | | Ex. 11 | Ex. 12 | Ex. 13 | Ex. 14 | Ex. 15 | Ex. 16 | Ex. 17 | Ex. 18 | Ex. 19 | Ex. 20 |
| Relative Dielectric Constant | | 2.7 | 2.2 | 2.2 | 2.2 | 2.2 | 2.2 | 2.2 | 2.2 | 2.4 | 2.2 |
| High-speed Four Ball Test 1 | N | 785 | 785 | 785 | 785 | 785 | 785 | 618 | 981 | 981 | 785 |
| High-speed Four Ball Test 2 | mm | 0.55 | 0.62 | 0.53 | 0.55 | 0.60 | 0.55 | 0.55 | 0.57 | 0.55 | 0.55 |

TABLE 11

| Performance Evaluation of Lubricating Oil Composition | | Examples | | | | | | | | | | |
|---|---|---|---|---|---|---|---|---|---|---|---|---|
| | | Ex. 21 | Ex. 22 | Ex. 23 | Ex. 24 | Ex. 25 | Ex. 26 | Ex. 27 | Ex. 28 | Ex. 29 | Ex. 30 | Ex. 31 |
| Relative Dielectric Constant | | 2.2 | 3.0 | 3.0 | 2.1 | 2.7 | 2.2 | 2.2 | 2.2 | 2.2 | 2.5 | 2.2 |
| High-speed Four Ball Test 1 | N | 785 | 785 | 981 | 618 | 785 | 785 | 981 | 785 | 981 | 981 | 785 |
| High-speed Four Ball Test 2 | mm | 0.55 | 0.60 | 0.55 | 0.60 | 0.55 | 0.55 | 0.57 | 0.60 | 0.62 | 0.60 | 0.55 |

TABLE 12

| Performance Evaluation of Lubricating Oil Composition | | Comparative Examples | | | | | | | | | |
|---|---|---|---|---|---|---|---|---|---|---|---|
| | | Co. Ex. 1 | Co. Ex. 2 | Co. Ex. 3 | Co. Ex. 4 | Co. Ex. 5 | Co. Ex. 6 | Co. Ex. 7 | Co. Ex. 8 | Co. Ex. 9 | Co. Ex. 10 |
| Relative Dielectric Constant | | 2.1 | 2.2 | 2.2 | 2.2 | 2.2 | 3.5 | 3.5 | 6.0 | 6.0 | 5.8 |
| High-speed Four Ball Test 1 | N | 490 | 618 | 618 | 618 | 392 | 981 | 490 | 618 | 981 | 981 |
| High-speed Four Ball Test 2 | mm | 0.80 | 0.80 | 0.78 | 0.79 | 0.70 | 0.55 | 0.55 | 0.55 | 0.55 | 0.62 |

The lubricating oil compositions of Examples 1-31 have shown good results in electrical insulation, seizure resistance, and wear resistance.

On the other hand, the lubricating oil composition of Comparative Example 1, in which the (B) alkaline earth metal detergent was not used, showed poor results in seizure resistance and wear resistance.

The lubricating oil compositions of Comparative Examples 2 to 4, in which the (C) triazole-based compound represented by general formula (1) or (2) was not used, showed poor results in wear resistance.

The lubricating oil composition of Comparative Example 5, in which the (D) sulfur-containing compound was not used, showed poor results in seizure resistance and wear resistance.

The lubricating oil composition of Comparative Example 6, in which the (B) alkaline earth metal detergent was used in excess, showed poor result in electrical insulation. The lubricating oil composition of Comparative Example 7 in which the amount of (C) triazole-based compound represented by general formula (1) or (2) was excessive, showed poor results in electrical insulation and seizure resistance.

The lubricating oil compositions of Comparative Example 8 in which the amount of the (D) sulfur-containing heterocyclic ether compound (amount of sulfur) was excessive and of Comparative Example 10 in which the amount of sulfide compound (amount of sulfur) was excessive showed poor results in electrical insulation.

The lubricating oil composition of Comparative Example 9 in which the amount of the (E) ashless dispersant was excessive showed poor result in electrical insulation.

The invention claimed is:

1. A lubricating oil composition comprising:

(A) a lubricant base oil;

(B) an alkaline earth metal detergent, wherein the amount of the alkaline earth metal is 50 ppm or more by mass and 500 ppm or less by mass on the basis of the total amount of the lubricating oil composition;

(C) 0.005% or more by mass and 0.90% or less by mass of a triazole-based compound represented by the following general formula (1) or (2), on the basis of the total amount of the lubricating oil composition:

(1)

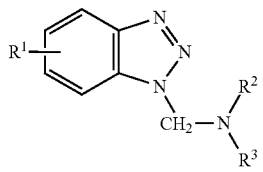

wherein $R^1$ is a hydrogen atom or a methyl group, and $R^2$ and $R^3$ are each independently a hydrogen atom or a linear or branched hydrocarbon having 1 to 18 carbons, (2)

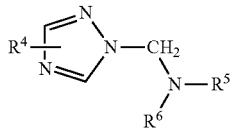

wherein $R^4$ is a hydrogen atom or a methyl group, and $R^5$ and $R^6$ are each independently a hydrogen atom or a linear or branched hydrocarbon having 1 to 18 carbons;

(D) at least one sulfur-containing compound selected from the group consisting of a sulfur-containing heterocyclic ether compound and a sulfide compound, wherein the amount of sulfur is 300 ppm or more by mass and 2000 ppm or less by mass, on the basis of the total amount of the lubricating oil composition; and (E) 0.010% or more by mass and 4.0% or less by mass of an ashless dispersant on the basis of the total amount of the lubricating oil composition.

2. The lubricating oil composition according to claim 1, wherein the content of the (B) alkaline earth metal detergent is 80 mass ppm or more and 300 mass ppm or less as the amount of alkaline earth metal, on the basis of the total amount of the lubricating oil composition.

3. The lubricating oil composition according to claim 1, wherein the (B) alkaline earth metal detergent is an alkaline earth metal sulfonate.

4. The lubricating oil composition according to claim 1, wherein the total base number of the (B) alkaline earth metal detergent is 100 mg KOH/g or more and 500 mg KOH/g or less.

5. The lubricating oil composition according to claim 1, wherein the content of the (C) triazole-based compound is 0.03% or more by mass and 0.20% or less by mass on the basis of the total amount of the lubricating oil composition.

6. The lubricating oil composition according to claim 1, wherein the (D) sulfur-containing heterocyclic ether compound is a sulfolan-based compound.

7. The lubricating oil composition according claim 1, wherein the (D) sulfide compound is represented by the following general formula (15):

$$R^{27}—S—R^{28} \quad (15)$$

wherein $R^{27}$ and $R^{28}$ are each independently a substituted or unsubstituted hydrocarbon group having 2 to 20 carbons, and at least one of $R^{27}$ and $R^{28}$ has a hydroxy group and/or a carboxyl group as a substituent.

8. The lubricating oil composition according to claim 1, wherein the content of the (E) ashless dispersant is 0.30% or more by mass and 2.5% or less by mass on the basis of the total amount of the lubricating oil composition.

9. The lubricating oil composition according to claim 1, wherein the (E) ashless dispersant is alkenyl succinimide or a derivative thereof.

10. The lubricating oil composition according to claim 1, wherein the (E) ashless dispersant comprises a boric acid modified compound of alkenyl succinimide.

11. The lubricating oil composition according to claim 1, wherein when the (A) lubricant base oil contains an ester base oil, the content of the ester base oil is 10% or less by mass on the basis of the total amount of the (A) lubricant base oil.

12. The lubricating oil composition according to claim 1, further comprising 100 to 1500 ppm by mass of a phosphorous compound as an amount of phosphorus element on the basis of the total amount of the lubricating oil composition.

13. The lubricating oil composition according to claim 12, wherein the (F) phosphorus-based compound is phosphite ester.

14. The lubricating oil composition according to claim 12, wherein the (F) phosphorus-based compound is a zinc dialkyldithiophosphate.

15. A power train of a hybrid or an electric vehicle comprising the lubricating oil composition according to claim 1.

16. The power train according to claim 15, wherein the lubricating oil composition is a motor cooling oil or a reducer oil.

17. A method of lubricating a power train of a hybrid or an electric vehicle, comprising applying to the power train the lubricating oil composition according to claim 1.

18. The lubricating oil composition according to claim 2, wherein the (B) alkaline earth metal detergent is an alkaline earth metal sulfonate.

19. The lubricating oil composition according to claim 18, wherein the total base number of the (B) alkaline earth metal detergent is 100 mg KOH/g or more and 500 mg KOH/g or less.

* * * * *